US011051634B2

(12) United States Patent
Telford

(10) Patent No.: US 11,051,634 B2
(45) **Date of Patent: *Jul. 6, 2021**

(54) ADJUSTABLE CHILD CARRIER

(71) Applicant: The ERGO Baby Carrier, Inc., Los Angeles, CA (US)

(72) Inventor: Rodney V. Telford, Kula, HI (US)

(73) Assignee: THE ERGO BABY CARRIER, INC., Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/551,286

(22) Filed: Aug. 26, 2019

(65) Prior Publication Data

US 2019/0380508 A1 Dec. 19, 2019

Related U.S. Application Data

(63) Continuation of application No. 15/337,813, filed on Oct. 28, 2016, now Pat. No. 10,426,275.

(60) Provisional application No. 62/248,745, filed on Oct. 30, 2015.

(51) Int. Cl.
*A47D 13/00* (2006.01)
*A47D 13/02* (2006.01)

(52) U.S. Cl.
CPC ..... *A47D 13/025* (2013.01)

(58) Field of Classification Search
CPC ..... A47D 13/025
USPC ..... 224/159
See application file for complete search history.

(56) References Cited

U.S. PATENT DOCUMENTS

| | | | |
|---|---|---|---|
| 268,932 | A | 12/1882 | Poirier |
| 576,292 | A | 2/1897 | Vanderburgh |
| 982,376 | A | 1/1911 | MacFarlane |
| 2,212,746 | A | 8/1940 | Nunn |
| 2,599,474 | A | 6/1952 | Mills |
| 2,994,300 | A | 8/1961 | Grahling |
| 3,097,773 | A | 7/1963 | Cunningham |
| 3,229,873 | A | 1/1966 | Hershman |
| 3,275,373 | A | 9/1966 | Card |
| 3,327,914 | A | 6/1967 | Abram |
| 3,481,517 | A | 12/1969 | Aukerman |
| 3,780,919 | A | 12/1973 | Hansson |
| 3,840,162 | A | 10/1974 | Horenstein et al. |
| 3,871,562 | A | 3/1975 | Grenier |
| 3,964,654 | A | 6/1976 | Wittenberger |

(Continued)

FOREIGN PATENT DOCUMENTS

| | | |
|---|---|---|
| CA | 1332928 | 11/1994 |
| CA | 2159241 | 3/1996 |

(Continued)

OTHER PUBLICATIONS

Office Action for U.S. Appl. No. 10/937,193, dated Aug. 14, 2007, 9 pgs.

(Continued)

*Primary Examiner* — Peter N Helvey
(74) *Attorney, Agent, or Firm* — Sprinkle IP Law Group

(57) ABSTRACT

An adjustable child carrier includes an adjustable bucket seat that can be adjusted to accommodate children of a wide range of sizes. The child carrier includes one or more adjustments that work alone or in cooperation to adjust the depth and width of the bucket seat area provided by the child carrier. The carrier is capable of supporting children of various sizes in an ergonomic position appropriate for the child's size.

20 Claims, 9 Drawing Sheets

(56) References Cited

U.S. PATENT DOCUMENTS 4,009,808 A 3/1977 Sharp
D247,199 S 2/1978 Carter
4,139,131 A 2/1979 Hathaway
4,149,687 A 4/1979 Nunemacher
D253,558 S 12/1979 Carter
4,234,229 A 11/1980 Arnold
4,273,215 A 6/1981 Leggett
4,318,502 A 3/1982 Lowe et al.
4,324,430 A 4/1982 Dimas, Jr.
4,333,591 A 6/1982 Case
D266,800 S 11/1982 Kula et al.
4,361,259 A 11/1982 Chanter
4,402,440 A 9/1983 Purtzer et al.
4,434,920 A 3/1984 Moore
4,467,945 A 8/1984 Schaapveld
4,469,259 A 9/1984 Krich et al.
4,479,595 A 10/1984 Opsal
D276,478 S 11/1984 Fallon
4,480,775 A 11/1984 Stanford
4,492,326 A 1/1985 Storm
D277,811 S 3/1985 Moore
4,550,800 A 11/1985 Dietrich
4,579,264 A 4/1986 Napolitano
4,651,366 A 3/1987 Lande et al.
4,666,017 A 5/1987 Zimmerman
4,724,988 A 2/1988 Tucker
4,746,044 A 5/1988 Arvizu
4,765,279 A 8/1988 Klickstein
4,800,629 A 1/1989 Ikeda
4,867,464 A 9/1989 Cook
4,946,119 A 8/1990 Hellhake
4,986,458 A 1/1991 Linday
5,071,047 A 12/1991 Cordisco
5,076,598 A 12/1991 Nauman
D324,607 S 3/1992 Nelson
5,114,059 A 5/1992 Thatcher
D334,253 S 3/1993 Balzarini
5,205,450 A 4/1993 DeRosier
5,205,451 A 4/1993 Manzer
5,224,637 A 7/1993 Colombo
5,240,159 A 8/1993 Gregory
5,246,152 A 9/1993 Dotseth
5,284,279 A 2/1994 Sason et al.
5,325,818 A 7/1994 Leech
D357,800 S 5/1995 Roan et al.
5,490,620 A 2/1996 Bergqvist
D370,996 S 6/1996 Shimura et al.
5,522,528 A 6/1996 Petricola
5,564,612 A 10/1996 Gregory
5,570,823 A 11/1996 Lindy
D377,116 S 1/1997 Shimura et al.
D385,105 S 10/1997 Fair
5,673,828 A 10/1997 Raedel et al.
5,678,739 A 10/1997 Darling et al.
5,690,258 A 11/1997 Kataoka et al.
5,692,655 A 12/1997 Fair et al.
5,699,555 A 12/1997 Schunter
5,725,139 A 3/1998 Smith
D395,161 S 6/1998 Fair et al.
5,772,088 A 6/1998 Nelson
5,791,535 A 8/1998 Roan et al.
D397,867 S 9/1998 Fair et al.
5,799,851 A 9/1998 Wulf et al.
5,813,580 A 9/1998 Fair
5,819,341 A 10/1998 Simantob et al.
5,848,576 A 12/1998 Colaianni
5,848,741 A 12/1998 Fair
5,927,235 A 7/1999 Olaiz
5,934,528 A 8/1999 Higuchi
D414,032 S 9/1999 Howell
5,988,742 A 11/1999 Stevens
6,055,686 A 5/2000 Knight
6,125,792 A 10/2000 Gee
6,155,579 A 12/2000 Eyman et al.
6,164,509 A 12/2000 Gausling et al.
6,179,175 B1 1/2001 Painter
D437,996 S 2/2001 Fair et al.
6,182,873 B1 2/2001 Christopher et al.
6,257,468 B1 7/2001 Yamazoe et al.
D453,066 S 1/2002 Norman
D455,546 S 4/2002 Norman
6,364,186 B1 4/2002 Gilmour et al.
6,409,060 B2 6/2002 Donine
6,415,969 B1 7/2002 Higuchi
6,443,339 B1 9/2002 Higuchi
6,499,165 B1 12/2002 Morgillo
6,520,391 B2 2/2003 Yen
6,609,642 B2 8/2003 Heinz et al.
D484,685 S 1/2004 Kassai et al.
6,681,973 B2 1/2004 Crumrine
D486,635 S 2/2004 Yagisawa et al.
6,715,651 B2 4/2004 Le Gal
6,722,543 B1 4/2004 Fitzgerald et al.
6,763,983 B2 7/2004 Norman
6,772,925 B2 8/2004 O'hare
D507,869 S 8/2005 Liistro et al.
D509,056 S 9/2005 Shiraishi et al.
7,073,866 B1 7/2006 Berdahl
7,168,600 B2 1/2007 Hwang
7,204,462 B2 4/2007 Lembo
7,204,468 B2 4/2007 Kintzele
7,255,620 B1 8/2007 Shepherd
7,322,498 B2 1/2008 Frost
7,494,031 B2 2/2009 Kassai et al.
D590,568 S 4/2009 Crutchfield
D597,788 S 8/2009 Ellis
7,766,199 B1 8/2010 Caperon
7,878,587 B1 2/2011 Leach
7,886,946 B2 2/2011 Gray
8,028,871 B2 10/2011 Gray
8,042,869 B2 10/2011 McClintock et al.
8,127,385 B1 3/2012 Goutevenier
8,172,116 B1 5/2012 Lehan et al.
8,636,181 B2 8/2012 Gunter et al.
8,272,546 B2 9/2012 Leistensnider
8,579,168 B2 12/2012 Zack et al.
8,408,435 B2 4/2013 Refsum
8,424,732 B1 4/2013 Lehan et al.
8,453,894 B2 6/2013 Jung et al.
8,590,757 B2 11/2013 Frost
8,701,949 B1 4/2014 Lehan et al.
8,752,739 B2 6/2014 Bergkvist et al.
9,022,260 B2 5/2015 Frost
9,179,758 B2 11/2015 Calilung et al.
9,185,993 B2 11/2015 Telford et al.
9,314,113 B1 4/2016 Lehan et al.
9,357,852 B2 6/2016 Salazar et al.
9,380,887 B2 7/2016 Frost
9,380,888 B2 7/2016 Telford et al.
9,439,515 B2 9/2016 Kim
9,713,391 B2 7/2017 Telford et al.
9,788,664 B2 10/2017 Andren
9,877,595 B2 1/2018 Wang
9,877,596 B2 1/2018 Schaarschmidt
9,955,797 B2 5/2018 Telford et al.
10,159,357 B2 12/2018 Telford
10,172,478 B2 1/2019 Telford
10,264,895 B2 4/2019 Lindeman
10,271,663 B2 4/2019 Salazar
10,426,275 B2 10/2019 Telford
10,506,885 B2 12/2019 Telford et al.
10,736,436 B2 8/2020 Telford
2002/0011503 A1 1/2002 Hwang
2002/0175194 A1 11/2002 Norman
2003/0106916 A1 6/2003 Boone
2004/0149790 A1 8/2004 Kassai et al.
2004/0155078 A1 8/2004 Hwang
2004/0238579 A1 12/2004 Krogh
2005/0045674 A1 3/2005 Rehbein
2005/0067549 A1 3/2005 Kintzele et al.
2005/0155995 A1 7/2005 Lee
2005/0184114 A1 8/2005 Hoff et al.
2005/0242136 A1 11/2005 Moriguchi et al.
2005/0279785 A1 12/2005 Liistro et al.

(56) References Cited

U.S. PATENT DOCUMENTS

| | | | |
|---|---|---|---|
| 2006/0011678 | A1 | 1/2006 | Kassai et al. |
| 2006/0076373 | A1 | 4/2006 | Labelle et al. |
| 2006/0130220 | A1 | 6/2006 | Morgan et al. |
| 2006/0261104 | A1 | 11/2006 | Zambrzycki |
| 2007/0029356 | A1 | 2/2007 | Moriguchi et al. |
| 2007/0057003 | A1 | 3/2007 | Keyes |
| 2008/0047987 | A1 | 2/2008 | Price |
| 2008/0283561 | A1 | 11/2008 | Parness |
| 2010/0025441 | A1 | 2/2010 | Blaney |
| 2010/0072236 | A1 | 3/2010 | Parness et al. |
| 2010/0147910 | A1 | 6/2010 | Schachtner |
| 2010/0187269 | A1 | 7/2010 | Leistensnider |
| 2010/0308087 | A1 | 12/2010 | Lindbloom |
| 2010/0308088 | A1 | 12/2010 | Lindblom |
| 2011/0062195 | A1 | 3/2011 | Jones et al. |
| 2011/0101051 | A1 | 5/2011 | Parness |
| 2011/0163136 | A1 | 7/2011 | Billingham |
| 2011/0290831 | A1 | 12/2011 | Wang |
| 2012/0037284 | A1 | 2/2012 | Korbonski |
| 2012/0043359 | A1 | 2/2012 | Bergkvist et al. |
| 2012/0205406 | A1 | 8/2012 | Schachtner |
| 2012/0241487 | A1 | 9/2012 | Zack et al. |
| 2012/0298702 | A1 | 11/2012 | Jung |
| 2014/0097215 | A1 | 4/2014 | Caperon |
| 2014/0167462 | A1 | 6/2014 | Lai et al. |
| 2014/0264361 | A1 | 9/2014 | Wang |
| 2015/0069097 | A1 | 3/2015 | Lindblom |
| 2015/0272342 | A1 | 10/2015 | Schaarschmidt |
| 2015/0374139 | A1 | 12/2015 | Salazar et al. |
| 2016/0150893 | A1 | 6/2016 | Salazar et al. |
| 2016/0296034 | A1 | 10/2016 | Telford |
| 2016/0316933 | A1 | 11/2016 | Antunovic |
| 2017/0119173 | A1 | 5/2017 | Telford |
| 2017/0150826 | A1 | 6/2017 | Salazar |
| 2017/0196374 | A1 | 7/2017 | Chen |
| 2018/0116426 | A1 | 5/2018 | Telford et al. |
| 2018/0184813 | A1 | 7/2018 | Salazar |
| 2018/0199730 | A1 | 7/2018 | Lundh |
| 2018/0235379 | A1 | 8/2018 | Lindeman et al. |
| 2018/0296005 | A1 | 10/2018 | Tsai |
| 2019/0075937 | A1 | 3/2019 | Salazar |
| 2019/0090557 | A1 | 3/2019 | Telford |
| 2019/0150633 | A1 | 5/2019 | Flaunty |
| 2019/0223619 | A1 | 7/2019 | Lindeman |
| 2020/0077806 | A1 | 3/2020 | Telford |
| 2020/0163466 | A1 | 5/2020 | Telford |
| 2020/0268169 | A1 | 8/2020 | Telford |

FOREIGN PATENT DOCUMENTS

| | | | |
|---|---|---|---|
| CA | 2 240 015 | | 1/2000 |
| CN | 203873395 | U | 10/2014 |
| CN | 104411213 | A | 3/2015 |
| DE | 29519530 | U1 | 4/1996 |
| DE | 22912951 | U1 | 1/2000 |
| DE | 20116046 | | 1/2002 |
| DE | 202008014412 | U1 | 9/2009 |
| DE | 202010011906 | | 11/2010 |
| DE | 202012104318 | | 11/2012 |
| DE | 20201420100616 | U1 | 6/2014 |
| EP | 0046672 | | 3/1982 |
| EP | 0437365 | A1 | 7/1991 |
| EP | 0662292 | | 7/1995 |
| EP | 0 995 380 | | 10/1998 |
| EP | 1055382 | | 11/2000 |
| EP | 1707082 | | 10/2006 |
| EP | 1765123 | | 6/2011 |
| EP | 2810587 | A1 | 12/2014 |
| ES | 251704 | | 10/1980 |
| FR | 1 545 820 | | 9/1967 |
| FR | 2 524 288 | | 10/1983 |
| FR | 2 794 010 | | 5/1999 |
| FR | 2 794 010 | | 1/2000 |
| FR | 2806279 | | 9/2001 |
| FR | 2823655 | A1 | 10/2002 |
| FR | 2 851 436 | | 8/2004 |
| GB | 2026848 | A | 8/1978 |
| GB | 2028633 | | 3/1980 |
| GB | 2314026 | | 12/1987 |
| GB | 2260687 | | 4/1993 |
| JP | 53-146441 | | 12/1978 |
| JP | 53-155443 | | 12/1978 |
| JP | 54-108131 | | 7/1979 |
| JP | 58-95766 | | 6/1983 |
| JP | 59-21273 | | 2/1984 |
| JP | 63-187956 | | 12/1988 |
| JP | 1-72158 | | 5/1989 |
| JP | 2-124107 | | 5/1990 |
| JP | 09-099842 | | 10/1995 |
| JP | 9-121987 | | 5/1997 |
| JP | 09-173185 | | 8/1997 |
| JP | 10-313929 | | 2/1998 |
| JP | 10-108764 | | 4/1998 |
| JP | 11046938 | | 2/1999 |
| JP | U3073766 | | 12/2000 |
| JP | P2001-104115 | | 4/2001 |
| JP | 2003-225119 | | 8/2003 |
| JP | 2005-131146 | | 10/2003 |
| JP | 2005-185426 | | 12/2003 |
| JP | 2004-000687 | | 1/2004 |
| JP | 2004-154468 | | 6/2004 |
| JP | 2005052584 | | 3/2005 |
| JP | 2005-288107 | | 10/2005 |
| JP | 2005-312826 | | 11/2005 |
| JP | 2013-118900 | | 12/2011 |
| JP | 2012-187352 | | 10/2012 |
| JP | 2012524603 | | 10/2012 |
| JP | 2014176494 | | 9/2014 |
| KR | 2000508690000 | | 10/1986 |
| KR | 1020020008534 | | 1/2002 |
| KR | 2003126950000 | | 4/2003 |
| KR | 2003158200000 | | 6/2003 |
| KR | 2003182590000 | | 6/2003 |
| KR | 2003201940000 | | 7/2003 |
| KR | 20-0324019 | | 8/2003 |
| KR | 2003337880000 | | 11/2003 |
| KR | 10-2004-0064749 | | 7/2004 |
| KR | 10-2007-0039806 | | 4/2007 |
| KR | 20-2009-0008715 | | 8/2009 |
| KR | 20-0447518 | | 1/2010 |
| KR | 20-2010-0010120 | | 10/2010 |
| KR | 20-2011-0005263 | | 5/2011 |
| KR | 200459659 | Y1 | 4/2012 |
| KR | 20-0477837 | | 7/2015 |
| WO | WO 95/05952 | A1 | 3/1995 |
| WO | WO 2001089978 | | 11/2001 |
| WO | WO 2009034233 | | 3/2009 |
| WO | WO 2010123447 | | 10/2010 |
| WO | WO 2011011158 | | 1/2011 |
| WO | WO 2011071441 | | 6/2011 |
| WO | WO 2012079787 | | 6/2012 |
| WO | WO 2014033134 | A1 | 3/2014 |
| WO | WO 2015053696 | | 4/2015 |
| WO | WO 2017/095752 | A1 | 6/2017 |

OTHER PUBLICATIONS

Office Action for U.S. Appl. No. 11/949,324, dated Oct. 6, 2009, 9 pgs.

Office Action for U.S. Appl. No. 11/949,324, dated Apr. 28, 2010, 9 pgs.

International Search Report and Written Opinion for PCT Application No. PCT/US2004/029614, completed on Feb. 11, 2005, dated Mar. 3, 2005, 9 pgs.

International Preliminary Report on Patentability for PCT/US2004/029614, dated Mar. 13, 2006, 7 pgs.

Examination Report for European Application No. 04 783 725.7, dated Sep. 21, 2007, 3 pgs.

Examination Report for European Application No. 04 783 725.7, dated Sep. 9, 2008, 4 pgs.

Examination Report for European Application No. 04 783 725.7, dated Sep. 10, 2009, 3 pgs.

(56) References Cited

OTHER PUBLICATIONS

Examination Report for European Application No. 04 783 725.7, dated Dec. 21, 2009, 5 pgs.
Examination Report for European Application No. 04 783 725.7, dated Jun. 1, 2010, 6 pgs.
Office Action for U.S. Appl. No. 11/949,324, dated Oct. 4, 2010, 10 pgs.
Office Action for U.S. Appl. No. 11/949,324, dated Jul. 18, 2011, 14 pgs.
Notice of Opposition filed on Mar. 13, 2012, against European Patent No. EP1765123 B1, 213 pgs.
Declaration of Judy Petterson regarding BabyTrekker with enclosures 1 and 2, dated May 26, 2011, 18 pgs.
International Search Report and Written Opinion for International Application No. PCT/US2014/026378, dated Jul. 21, 2014, 10 pgs.
Office Action for U.S. Appl. No. 14/685,235, dated May 22, 2015, 8 pgs.
International Preliminary Report on Patentability (Ch. I) for International Patent Application No. PCT/US2014/026378, dated Sep. 15, 2015, 6 pgs.
Office Action for U.S. Appl. No. 14/862,933, dated Oct. 30, 2015, 5 pgs.
Office Action for U.S. Appl. No. 14/685,235, dated Nov. 27, 2015, 8 pgs.
International Search Report and Written Opinion for International Patent Application No. PCT/US2016/026626, dated Jun. 30, 2016, 7 pgs.
Office Action for U.S. Appl. No. 15/177,114, dated Aug. 24, 2016, 10 pgs.
Petition for Inter Partes Review of U.S. Pat. No. 9,022,260, 94 pgs.
Petition for Inter Partes Review of U.S. Pat. No. 8,590,757, 100 pgs.
Baby Matey Soft Baby Carriers Literature, Kidpower Unlimited Inc., Toronto, ON, CA, 10 pgs.
BabyTrekker Instruction Manual, Petterson Infant Products, Flin Flon, MB, CA, 1998, 16 pgs.
Declaration of Richard N. Hinrichs, Ph.D and Appendix A thereto for Petition for Inter Partes Review of U.S. Pat. No. 9,022,260, 158 pgs.
Declaration of Richard N. Hinrichs, Ph.D and Appendix A thereto for Petition for Inter Partes Review of U.S. Pat. No. 8,590,757, 155 pgs.
Declaration of Shari Hall White and Appendix A thereto, Jun. 29, 2016, 12 pgs.
Declaration of Judy Pettersen and Exhibits thereto, Aug. 14, 2016, 50 pgs.
Nov. 24, 1998 Letter from U.S. ITC regarding U.S. tariff classification of babyTrekker, 2 pgs., retrieved from http://www.faqs.org/rulings/rulings1998NYD83381.html).
Feb. 2002 forum post from "USA", 2 pgs., retrieved from http://windsorpeak.com/vbulletin/showthread.php?185543-baby-bjorn-and-large-husband).
U.S. Trademark Serial No. 75057147 Documents, U.S. Patent and Trademark Office, 44 pgs.
Complaint, *The Ergo Baby Carrier, Inc.* v. *BOBA Inc.*, Case No. 2:15-cv-08946, In the United States District Court for the Central District of California, filed Nov. 17. 2015, 7 pgs.
Blaffer Hardy, S., Family Planning Primate Style, Mother Nature—A History of Mothers, Infants and Natural Selection, 2000, pp. 197-204.
Jones, Sandy, Back Packs and Soft Carriers, Guide to Baby Products, Consumers Digest, 1998, Ch. 4, pp. 33-40.
Longe, Jaqueline L., Baby Carrier, How Products are Made: An Illustrated Guide to Product Manufacturing, 2001, vol. 6, pp. 22-26.
Pelot, Ron P., et al., "Background Document for an Advanced Personal Load Carriage System for the Canadian Forces", Ergonomics Research Group, Queen's University, Kingston, ON, CA, Mar. 29, 1995, 148 pgs.
Brewer, Gail S., A Quick Guide for Starting Right, Baby Carriers, Right from the Start: Meeting the Challenges of Mothering Your Unborn and Newborn Baby, 1981, pp. 159-160.
Salter, R.B., "Etiology, Pathogenesis and Possible Prevention of Congenital Dislocation of the Hip", The Canadian Medical Association Journal, vol. 98, No. 20, May 18, 1968.
Jones, Sandy, Getting Around, Guide to Baby Products, Consumers Digest, 2001, pp. 41, 55-60, 157-160, 199-201.
Gilligan, Shannon, Best for Baby: A Selective Consumer's Guide to Products and Services from Infancy to Preschool, 1988, pp. 41-46.
O'Donohue, Rosaleen, Baby Rides the Asian Way, The Australian Women's Weekly, Jul. 23, 1969 at p. 9.
Doan, Marlyn, Children's Gear, Starting Small in the Wilderness, The Sierra Club Outdoors Guide for Families, 1979, at pp. 161-167.
Guide to the Ann Moore Innovative Lives Presentation, 1999, Archives Center, National Museum of American History, Smithsonian Institute, Aug. 2010, 12 pgs., retrieved from http://amhistory.si.edu/archives/AC0706.pdf).
Warren, A.J., "The Mom Who Invented the Snugli" , CBS News, Mar. 6, 2001, 4 pgs., retrieved from http://www.cbsnews.com/news/the-mom-who-invented-the-snugli/.
Bach, John, "Practical Inventor Influenced American Culture", University of Cincinnati UC Magazine, Aug. 2010, 6 pgs.
"Eager Market for Baby Carrier" The Gazette, Montreal May 15, 1984: C-19 (accessed at https://news.google.com/newspapers?id=zA0vAAAAIBAJ&sjid=mqUFAAAAIBAJ&pg=1454%2C2468510).
Roseman, E., et al., Baby Carriers, The Canadian Parents' Sourcebook, 1986, at pp. 149-153.
Rafelman, Rachel, The Portable Baby, Baby Gear for the First Year, 1997, pp. 40-41.
Laury, Jean Ray, Baby Carrier, A Treasury of Needlecraft Gifts for the New Baby, 1976, pp. 90-93.
Byrnes, E.A., "A Blue-Jean 'Person Pack': Toting the Tot on the Trail", The Mother Earth News, No. 75, May/Jun. 1982, p. 164.
The Kozy Family, 16 pgs., retrieved from Web Archives of http://www.kozycarrier.homestead.com/.
Packababy, 17 pgs., retrieved from Web Archives of http://www.packababy.com/.
Welcome to Sutemigear, 10 pgs., retrieved from Web Archives of http://sutemigear.com/.
"The Pick of the Extended Trek Packs" Backpacker, Oct. 1997, vol. 23, pp. 58-69.
Jones, Sandy, Back Packs and Soft Carriers, Guide to Baby Products, Consumers Reports, 1991, pp. 9-15.
Baby Trekker—Advantages, 2 pgs., retrieved from https://web.archive.org/web/20000708141511/http://www.babytrekker.com/advantages.htm.
Evenflo Soft Carriers, 2 pgs., retrieved from https://web.archive.org/web/20010331081113/http://www.evenflo.com/ep/furniture/softcarrier.phtml.
Newspaper ad for Napsak Soft Baby Carrier by Evenflow, The Pittsburgh Press (Pittsburgh, Pennsylvania), Thursday, Dec. 12, 1991, p. 57.
Pelot, R.P. et al., "A Static Biomechanical Load Carriage Model", RTO HFM Specialist Meeting on Soldier Mobility Innovation in Load Carriage System Design and Evaluation, Kingston, CA, Jun. 27-29, 2000, 13 pgs.
Knapik, J., "Physiological, Biomechanical and Medical Aspects of Soldier Load Carriage", RTO HFM Specialist Meeting on Soldier Mobility Innovation in Load Carriage System Design and Evaluation, Kingston, CA, Jun. 27-29, 2000, 20 pgs.
Holewijn, M., "Physiological Strain Due to Load Carrying", European Journal of Applied Physiology, 1990, 61:237-245.
Frame Carriers, 1 pg., retrieved from https://web.archive.org/web/20000526184535/http://www.evenflo.com/ep/furniture/framecarrier.phtml.
Aronson, D.D. et al., "Developmental dysplasia of the hip", Pediatrics, Aug. 1994, vol. 94(2), 202, 11 pgs.
Hodgson, A.R., "Congenital Dislocation of the Hip", British Medical Journal, Sep. 7, 1961, p. 647.
Leveau, Barney F., et al., "Developmental biomechanics," Physical Therapy, 64.12, 1984:1878.
The Age, Mar. 5, 1970 at p. 14.

(56) References Cited

OTHER PUBLICATIONS

Certified Translation of "What parents should watch out for when buying babywearing carriers" by Kirkiliones, retrieved from http://web.archive.org/web/20010719033113/http://www.continuu m-concept.de/liedkir.htm).
Kirkilionis, E., Das Tragen des Säuglings im Hüftsitz—eine spezielle Anpassung des menschlichen Traglings. Zoologische Jahrbücher, 1992, 96 (3), 395-415.
Kirkilionis, E., Worauf Eltern beim Kauf von Tragehilfen für Säuglinge achten sollten, 1994.
Kirkilionis, E., Die Grundbedürfnisse des Säuglings und deren medizinische Aspekte—dargestellt und charakterisiert am Jungentypus Tragling. notabene medici, 1997, 27 (2), 61-66, 27 (3), 117-121.
Kirkilionis, E., Ein Baby will gatragen sein, 1999, 171 pgs.
"The Beginning" Ergo Baby Blog, 13 pgs., retrieved from https://blog.ergobaby.com/2011/02/the-beginning/).
Rei—Kelty Kangaroo Child Carrier, 2 pgs., retrieved from https://web.archive.org/web/19970222133805/http://rei.com/shopping/store3/CAMPING/BABY_CARRIERS/BABY_CARRIERS/b ud/617589.html.
Tough Traveler, Kidsystems, 3 pgs., retrieved from http://web.archive.org/web/20011106132550/http://www.toughtraveler.com/cat7.html.
Mackie, H.W. et al, "The effect of simulated school load carriage configurations on shoulder strap tension forces and shoulder interface pressure", Applied Ergonomics, 36, 2005, pp. 199-206.
Hinrichs, et al., "An Investigation of the Inertial Properties of Backpacks Loaded in Various Configurations", United States Army Natick, Research and Development Laboratories, Natick, MA, 1982, 75 pgs.
Nelson, et al., "Effects of Gender, Load, and Backpack on Easy Standing and Vertical Jump Performance vol. II", United States Army Natick, Research and Development Laboratories, Natick, MA, Mar. 1982, 77 pgs.
Martin, et al., "Effects of Gender, Load, and Backpack on the Temporal and Kinematic Characteristics of Walking Gait vol. III", United States Army Natick, Research and Development Laboratories, Natick, MA, Apr. 1982, 77 pgs.
Martin, et al., "A Mathematical Model of the Inertial Properties of a Carrier-Backpack System vol. IV", United States Army Natick, Research and Development Laboratories, Natick, MA, May 1982, 89 pgs.
Definition of "flexed", Random House Webster's Unabridged Dictionary, Oct. 1999, Second Edition, p. 733.
Rose, Marion, Baby Carriers—Cultural History, Aware Parenting, Dec. 8, 2006, 11 pgs., retrieved from http://awareparenting.blogspot.com/2006/12/baby-carriers-cultural-history.html.
European Search Report for European Patent Application No. 14773586.4, dated Oct. 16, 2016, 9 pgs.
International Search Report and Written Opinion for International Patent Application No. PCT/US2016/059534, dated Jan. 3, 2017, 8 pgs.
Office Action Issued for Chinese Patent Application No. 201480023993.2, dated Jan. 11, 2017, 20 pages.
Office Action with English translation for Japanese Patent Application No. 2018-521974, dated Oct. 24, 2019, 7 pgs.
Office Action for U.S. Appl. No. 15/796,422, dated Nov. 21, 2019, 20 pgs.
Notice of Allowance for U.S. Appl. No. 15/796,422, dated Jul. 25, 2019, 5 pgs.
Notice of Allowance for U.S. Appl. No. 16/204,581, dated Aug. 19, 2019, 5 pgs.
Holewijn, Michael, "Physiological Strain Due to Load Carrying," European Journal of Applied Physiology and Occupational Physiology, Feb. 1990, 10 pgs.
BabyTrekker Instruction Manual, Pettersen Infant Products, Canada, 1998, 16 pgs.
BabyTrekker Instruction Manual, Pettersen Infant Products, Canada, 16 pgs.
Casses, R., "Infant Carriers and Spinal Stress," <<http://continuum-concept.org/reading/spinalstress.html>>, Jun. 16, 2002, 3 pgs.
Jones, S., "Guide to Baby Products," Consumer Reports, Completely Revised Seventh Edition, 2001, 21 pgs.
<<http://www.kelty.com/Kelty/index.cfm?fuseaction=Kids.ShowProduct&type=carrier&ID=12>>, Aug. 5, 2002, 1 pg.
"Kwik Sew," Pattern 1046, Kwik Sew Pattern Co., Inc., Minneapolis, MN, 8 pgs.
Declaration of Judy Pettersen regarding BabyTrekker, May 26, 2011, 18 pgs.
"The Baby Trekker Product Info," <<http://www.babytrekker.com/product.htm>>, Jun. 10, 2002, 1 pg.
"The Baby Trekker Testimonials," <<http://www.babytrekker.com/testimonials.htm>>, Dec. 21, 2001, 4 pgs.
"The Baby Trekker Testimonials," <<http://www.babytrekker.com/testimonials.htm>>, Sep. 16, 2002, 4 pgs.
"Baby/Toddler Sling," <<http://www3.telus.net/public/a6a83106/Sling/sling.html>>, Nov. 19, 2003, 5 pgs.
"First Journey Advantages," <<http://www.first-journey.com/advantage1pics/advantages1.html>>, Dec. 14, 2002, 1 pg.
"First Journey Advantages," <<http://www.first-journey.com/advantage2pics/advantages2.html>>, Dec. 14, 2002, 1 pg.
"First Journey Instructions," <<http://www.first-journey.com/instructions/instructions>>, Dec. 14, 2002, 1 pg.
"First Journey Photos & Quotes,"<<http://www.first-journey.com/photosandquotes/photos>>, Dec. 14, 2002, 2 pg.
First Journey Brochure, <<www.first-journey.com>>, 2002, 2 pgs.
<<http://koti.welho.com/skoivune/sakara/english/about/index.html>>, Apr. 30, 2003, 2 pgs.
<<http://koti.welho.com/skoivune/sakara/english/index.html>>, Jun. 24, 2003, 2 pgs.
<<http://koti.welho.com/skoivune/sakara/english/guide/index.html>>, Jun. 28, 2003, 1 pg.
<<http://koti.welho.com/skoivune/sakara/english/guide/ohje2.html>>, May 1, 2003, 1 pg.
<<http://koti.welho.com/skoivune/sakara/english/guide/ohje3.html>>, May 1, 2003, 1 pg.
<<http://koti.welho.com/skoivune/sakara/ohje/ohje4.html>>, May 2, 2003, 1 pg.
<<http://koti.welho.com/skoivune/sakara/ohje/ohje6.html>>, May 29, 2003, 1 pg.
<<http://koti.welho.com/skoivune/sakara/ohje/ohje7.html>>, May 9, 2003, 1 pg.
<<http://koti.welho.com/skoivune/sakara/english/order/index.html>>, Apr. 30, 2003, 1 pg.
<<http://koti.welho.com/skoivune/sakara/index2.html>>, Jun. 20, 2003, 2 pgs.
<<http://koti.welho.com/skoivune/sakara/sakarat/index.html>>, Apr. 30, 2003, 2 pgs.
Weego Soft Baby Carrier, Instructions for Use, Weego Babytragesäcke, Berlin, DE, 4 pgs.
<<http://www.weego.com/coinf.html>>, Aug. 6, 2002, 2 pgs.
<<http://www.weego.com/product.html>>, Dec. 11, 2001, 1 pg.
<<http://www.weego.com/fabric.html>>, Nov. 2, 2001, 2 pgs.
<<http://www.weego.com/preem.html>>, Aug. 6, 2002, 2 pgs.
<<http://www.weego.com/acatalog/ool.html>>, Jun. 5, 2002, 3 pgs.
<<http://www.weego.de/024.htm>>, Aug. 12, 2003, 1 pg.
<<http://www.weego.de/english/024.htm>>, Apr. 23, 2004, 1 pg.
<<http://www.weego.de/english/ortho.htm>>, Jun. 1, 2004, 1 pg.
<<http://www.weego.de/english/design.htm>>, Mar. 24, 2004, 1 pg.
<<http://www.weego.de/english/interaktiv.htm>>, Jul. 3, 2004, 1 pg.
<<http://www.weego.de/english/trageposition.htm>>, Apr. 23, 2004, 1 pg.
"6 in One Rider," Infantino, LLC, San Diego, California, 2002, 1 pg.
Assorted Photos, U.S. Appl. No. 60/501,396, filed Sep. 10, 2003, 3 pgs.
Wormleighton, A., "Baby Gifts: To Sew, Applique, Crochet and Knit," Copyright Marshall Cavendish Limited, 1998, 13 pgs.
"Baby Pack Baby Carrier," <<http://www.beginnings.org/shop/buikrugdrager_babypack.htm>>, Feb. 4, 2002, 1 pg.

(56) References Cited

OTHER PUBLICATIONS

"Baby Trekker Instruction Sheet," 2 pgs.
Constance, S., "Backpacking the Baby," Sydney Morning Herald, Dec. 1, 1998, 3 pgs.
File History for U.S. Appl. No. 14/685,235, filed Apr. 13, 2015, 460 pgs.
"Chinese Baby Carrier," <<http://portebebe.free.fr>>, Jun. 2002, 7 pgs.
Coff, H., "Cut Scheduling for Optimum Fabric Utilization in Apparel Production," Georgia Institute of Technology, Nov. 1976, 141 pgs.
"Baby Matey, Soft Baby Carriers," Copyright Kidpower Unlimited Inc., 4 pgs.
"Theodore Bean Infants & Toddlers Carriers & Accessories," Theodore Bean Adventure Company Inc., 2000, 16 pgs.
"Clinical Practice Guideline: Early Detection of Developmental Dysplasia of the Hip," American Academy of Pediatrics vol. 105, No. 4, Apr. 2000, 10 pgs.
File History for European Patent Application No. 04783725.7, filed Sep. 10, 2004, 693 pgs.
"First Journey Visite Guidée," Pettersen Infant Products, www.first-journey.com, 2004, 2 pgs.
"First Journey Tour Guide," Pettersen Infant Products, www.first-journey.com, 2002, 2 pgs.
"Graco Soft Carrier Owner's Manual, Model 5070 Series," Graco Children's Products, Inc., 1999, 7 pgs.
Jones et al., "Guide to Baby Products," Consumer Reports Books, Fourth Edition, Dec. 1995, 10 pgs.
Harman et al., "The Effects of Backpack Weight on the Biomechanics of Load Carriage," Military Division, U.S. Army Research Institute of Environmental Medicine, May 3, 2000, 72 pgs.
"In & Out Carrier Instructions," Hauck Fun for Kids, 2003, 3 pgs.
"In & Out Carrier Instructions," Hauck Fun for Kids, Aug. 2003, 3 pgs.
"Wearing Your Baby," <<http://wearingyourbaby.co.nz/history>>, 2014, 11 pgs.
Longe, J., "How Products are Made: An Illustrated Guide to Product Manufacturing," 2001, vol. 6, 8 pgs.
"GVP Gear G4," <<http://www.gvpgear.com/g4.asp>>, Jun. 2, 2002, 3 pgs.
"Backpack Tips," <<http://backpacking.net/gearpack-tips.html>>, Jun. 2, 2002, 6 pgs.
"Make Your Own G4 Pack," <<http://www.gvpgear.com/make_your_own.asp>>, Jun. 2, 2002, 17 pgs.
King, F.H, "Farmers of Forty Centuries," Copyright 2002 Blackmask Online, www.blackmask.com, 118 pgs.
"Worauf Eltern beim Kauf von Tragehilfen fuer Sauglinge achten sollten"—Things parents shopping for infant carriers should look out for, <<http://www.continuum-concept.de/liedkir.htm>>, Jul. 19, 2001, 4 pgs.
"Lifter Baby Carrier," <<http://www.beginnings.org/shop/buikheuprugdragers_lifter.htm>>, Jun. 19, 2002, 2 pgs.
"Ultralight Pack," <<http://www.backpacking.net/makegear/gvp-pack/>>, Mar. 1, 2003, 29 pgs.
Martin, J. and Hooper, R., "Military Load Carriage: A Novel Method of Interface Pressure Analysis," RTO HFM Specialists' Meeting on "Soldier Mobility: Innovations in Load Carriage System Design and Evaluation," Jun. 27-29, 2000, 9 pgs.
"Miguel Inspired Originals," <<http://miguelinspired.com/about.html>>, Oct. 30, 2005, 2 pgs.
"Miguel Inspired Originals," <<http://miguelinspired.com/gpage2.html>>, Oct. 30, 2005. 5 pgs.
"Miguel Inspired Originals," <<http://miguelinspired.com/gpg.html>>, Oct. 30, 2005, 2 pgs.
"Miguel Inspired Originals," <<http://miguelinspired.com/gpage3.html>>, Oct. 30, 2005, 1 pg.
"The Australian Women's Weekly," vol. 37, No. 8, Jul. 23, 1969, 80 pgs.
"For Shane Gould Innes—Motherhood is a Mind," The Australian Women's Weekly, <<National library of Australia—http://nla.gov.au/nla-news-page5623013>>, Oct. 11, 1978, 1 pg.
". . . Blowing Experience," The Australian Women's Weekly, <<National library of Australia—http://nla.gov.au/nla-news-page5623014>>, Oct. 11, 1978, 1 pg.
Cessnock Eagle and South Mattland Recorder, vol. 32, No. 4162, Jun. 22, 1944, <<National library of Australia—http://nla.gov.au/nla-news-page10625124>>, 1 pg.
File History for U.S. Appl. No. 10/937,193, filed Sep. 9, 2004, 135 pgs.
"Porte-bébé chinois," <<http://portebebe.free.fr/>>, Jun. 5, 2002, 6 pgs.
U.S. Appl. No. 60/501,396, filed Sep. 10, 2003, 9 pgs.
"Device for Worn Baby," Patent Translate Description of Russian Application No. RU12646, 3 pgs.
Santa Cruz Sentinel, <<https://www.newspapers.com/image/71319712>>, Jul. 26, 1987, 1 pg.
Krantz, L. and Ludman-Exley, S., "The Best of Everything for Your Baby," Copyright 2000 by Prentice Hall, Inc., 18 pgs.
"Home Watch," The Sydney Morning Herald <<https://www.newspapers.com/image/123957115>>, Jan. 10, 1993, 1 pg.
Chancellor, N., "It's a Shoulder Style," The Sydney Morning Herald, <<https://www.newspapers.com/image/123869066>>, Jun. 24, 1947, 1 pg.
Constance, M., "Backpacking the Baby," The Sydney Morning Herald, <<https://www.newspapers.com/image/120542968>>, Dec. 1, 1988, 1 pg.
Gebrauchsanweisung (User's Manual), Weego Baby Carrier, 4 pgs.
"Why Choose the Wilkinet?," <<http://www.wilkinet.co.uk/WhyChoose.asp>>, Apr. 17, 2003, 2 pgs.
Wilkinet—FAQ, <<http://www.wilkinet.co.uk/FAQs.asp>>, Feb. 17, 2003, 3 pgs.
Wilkinet—History of the Wilkinet Baby Carrier, <<http://www.wilkinet.co.uk/History.asp>>, Feb. 17, 2003, 3 pgs.
Wilkinet—Reviews and Testimonials, <<http://www.wilkinet.co.uk/ReviewsParents.asp>>, Feb. 18, 2003, 2 pgs.
Wilkinet—Reviews and Testimonials, <<http://www.wilkinet.co.uk/ReviewsPress.asp>>, Feb. 18, 2003, 2 pgs.
Wilkinet—Product Views, <<http://www.wilkinet.co.uk/BabyCarriers.asp>>, Feb. 17, 2003, 2 pgs.
Wilkinet—Instructional Videos, <<http://www.wilkinet.co.uk/Videos.asp>>, Feb. 18, 2003, 2 pgs.
Appendix A: Baby Matey Non-Patent Literature as Cited on the Face of U.S. Pat. No. 4,986,458 ("Baby Matey Literature") Invalidity Chart, *The Ergo Baby Carrier, Inc.* v. *BOBA, Inc.*, Case No. 2:15-cv-08946, In the United States District Court for the Central District of California, Jul. 15, 2016, 21 pgs.
Appendix BB: Consumer Reports Guide to Baby Products by Sandy Jones, published in 2001 ("Guide to Baby Products") Invalidity Chart, *The Ergo Baby Carrier, Inc.* v. *BOBA Inc.*, Case No. 2:15-cv-08946, In the United States District Court for the Central District of California, Jul. 15, 2016, 11 pgs.
Appendix AAA: Japanese Pub. No., S54-108131 ("The '131 Patent") Invalidity Chart, *The Ergo Baby Carrier, Inc.* v. *BOBA Inc.*, Case No. 2:15-cv-08946, In the United States District Court for the Central District of California, Jul. 15, 2016, 11 pgs.
Appendix B: Baby Matey System Invalidity Chart, *The Ergo Baby Carrier, Inc.* v. *BOBA Inc.*, Case No. 2:15-cv-08946, In the United States District Court for the Central District of California, Jul. 15, 2016, 22 pgs.
Appendix BB: U.S. Patent No. 3,780,919 ("Hansson") Invalidity Chart, *The Ergo Baby Carrier, Inc.* v. *BOBA Inc.*, Case No. 2:15-cv-08946, In the United States District Court for the Central District of California, Jul. 15, 2016, 4 pgs.
Appendix BBB: UK Patent App. No. GB 2026848 ("David") Invalidity Chart, *The Ergo Baby Carrier, Inc.* v. *BOBA Inc.*, Case No. 2:15-cv-08946, In the United States District Court for the Central District of California, Jul. 15, 2016, 5 pgs.
Appendix C: Canadian Patent No. 1332928 ("Pettersen") Invalidity Chart, *The Ergo Baby Carrier, Inc.* v. *BOBA Inc.*, Case No. 2:15-cv-08946, In the United States District Court for the Central District of California, Jul. 15, 2016, 18 pgs.

(56) References Cited

OTHER PUBLICATIONS

Appendix CC: "Physiological Strain Due to Load Carrying" by Michael Holewijn, published in European Journal of Applied Physiology and Occupational Physiology, Feb. 1990 ("Holewijn") Invalidity Chart, *The Ergo Baby Carrier, Inc.* v. *BOBA Inc.*, Case No. 2:15-cv-08946, In the United States District Court for the Central District of California, Jul. 15, 2016, 12 pgs.
Appendix CCC: DIY Baby Sling System Invalidity Chart, *The Ergo Baby Carrier, Inc.* v. *BOBA Inc.*, Case No. 2:15-cv-08946, In the United States District Court for the Central District of California, Jul. 15, 2016, 11 pgs.
Appendix D: babyTrekker Instruction Manual copyright date stamped 1998 ("1998 babyTrekker Manual") Invalidity Chart, *The Ergo Baby Carrier, Inc.* v. *BOBA Inc.*, Case No. 2:15-cv-08946, In the United States District Court for the Central District of California, Jul. 15, 2016, 19 pgs.
Appendix DD: Kelty Kangaroo Invalidity Chart, *The Ergo Baby Carrier, Inc.* v. *BOBA Inc.*, Case No. 2:15-cv-08946, In the United States District Court for the Central District of California, Jul. 15, 2016, 7 pgs.
Appendix DDD: Kozy System Invalidity Chart, *The Ergo Baby Carrier, Inc.* v. *BOBA Inc.*, Case No. 2:15-cv-08946, In the United States District Court for the Central District of California, Jul. 15, 2016, 16 pgs.
Appendix E: babyTrekker Instruction Manual ("babyTrekker Manual") Invalidity Chart, *The Ergo Baby Carrier, Inc.* v. *BOBA Inc.*, Case No. 2:15-cv-08946, In the United States District Court for the Central District of California, Jul. 15, 2016, 21 pgs.
Appendix EE: Kirkiliones Invalidity Chart, *The Ergo Baby Carrier, Inc.* v. *BOBA Inc.*, Case No. 2:15-cv-08946, In the United States District Court for the Central District of California. Jul. 15, 2016, 9 pgs.
Appendix EEE: Packababy System Invalidity Chart, *The Ergo Baby Carrier, Inc.* v. *BOBA Inc.*, Case No. 2:15-cv-08946, In the United States District Court for the Central District of California, Jul. 15, 2016, 17 pgs.
Appendix F: babyTrekker System Invalidity Chart, *The Ergo Baby Carrier, Inc.* v. *BOBA Inc.*, Case No. 2:15-cv-08946, In the United States District Court for the Central District of California, Jul. 15, 2016, 16 pgs.
Appendix FF: "Physicological, Biomechanical and Medical Aspects of Soldier Load Carriage" by Joseph Knapik, Presented in Jun. 2000 ("Knapik") Invalidity Chart, *The Ergo Baby Carrier, Inc.* v. *BOBA Inc.*, Case No. 2:15-cv-08946, In the United States District Court for the Central District of California, Jul. 15, 2016, 11 pgs.
Appendix FFF: Sakara System Invalidity Chart, *The Ergo Baby Carrier, Inc.* v. *BOBA Inc.*, Case No. 2:15-cv-08946, In the United States District Court for the Central District of California, Jul. 15, 2016, 17 pgs.
Appendix G: First Journey System Invalidity Chart, *The Ergo Baby Carrier, Inc.* v. *BOBA Inc.*, Case No. 2:15-cv-08946, In the United States District Court for the Central District of California, Jul. 15, 2016, 21 pgs.
Appendix GG: U.S. Pat. No. 4,434,920 ("Moore") Invalidity Chart, *The Ergo Baby Carrier, Inc.* v. *BOBA Inc.*, Case No. 2:15-cv-08946, In the United States District Court for the Central District of California, Jul. 15, 2016, 6 pgs.
Appendix GGG: Sutemi System Invalidity Chart, *The Ergo Baby Carrier, Inc.* v. *BOBA Inc.*, Case No. 2:15-cv-08946, In the United States District Court for the Central District of California, Jul. 15, 2016, 12 pgs.
Appendix H: French Patent Pub. No. 2795010 ("Ducruet") Invalidity Chart, *The Ergo Baby Carrier, Inc.* v. *BOBA Inc.*, Case No. 2:15-cv-08946, In the United States District Court for the Central District of California, Jul. 15, 2016, 8 pgs.
Appendix HH: "A Static Biomechanical Load Carriage Model" by R.P. Pelot et al., Presented in Jun. 2000 ("Pelet") Invalidity Chart, *The Ergo Baby Carrier, Inc.* v. *BOBA Inc.*, Case No. 2:15-cv-08946, In the United States District Court for the Central District of California, Jul. 15, 2016, 13 pgs.
Appendix HHH; Casses Invalidity Chart, *The Ergo Baby Carrier, Inc.* v. *BOBA Inc.*, Case No. 2:15-cv-08946, In the United States District Court for the Central District of California, Jul. 15, 2016, 5 pgs.
Appendix I: U.S. Pat. No. 4,986,458 ("Linday") Invalidity Chart, *The Ergo Baby Carrier, Inc.* v. *BOBA Inc.*, Case No. 2:15-cv-08946, In the United States District Court for the Central District of California, Jul. 15, 2016, 16 pgs.
Appendix II: Pony Ride Invalidity Chart, *The Ergo Baby Carrier, Inc.* v. *BOBA Inc.*, Case No. 2:15-cv-08946, In the United States District Court for the Central District of California, Jul. 15, 2016, 7 pgs.
Appendix III: U.S. Pat. No. 6,182,873 ("Christopher") Invalidity Chart, *The Ergo Baby Carrier, Inc.* v. *BOBA Inc.*, Case No. 2:15-cv-08946, In the United States District Court for the Central District of California, Jul. 15, 2016, 2 pgs.
Appendix J: U.S. Pat. No. 4,469,259 ("Krich") Invalidity Chart, *The Ergo Baby Carrier, Inc.* v. *BOBA Inc.*, Case No. 2:15-cv-08946, In the United States District Court for the Central District of California, Jul. 15, 2016, 8 pgs.
Appendix JJ: U.S. Pat. No. 5,114,059 ("Thatcher") Invalidity Chart, *The Ergo Baby Carrier, Inc.* v. *BOBA Inc.*, Case No. 2:15-cv-08946, In the United States District Court for the Central District of California, Jul. 15, 2016, 4 pgs.
Appendix JJJ: U.S. Pat. No. 6,155,579 ("Eyman") Invalidity Chart, *The Ergo Baby Carrier, Inc.* v. *BOBA Inc.*, Case No. 2:15-cv-08946, In the United States District Court for the Central District of California, Jul. 15, 2016, 2 pgs.
Appendix K: "A Blue-Jean Person Pack," by E.A. Byrnes as published on p. 164 of the May/Jun. 1982 issue of The Mother Earth News ("Byrnes") Invalidity Chart, *The Ergo Baby Carrier, Inc.* v. *BOBA Inc.*, Case No. 2:15-cv-08946, In the United States District Court for the Central District of California, Jul. 15, 2016, 21 pgs.
Appendix KK: Weego System Invalidity Chart, *The Ergo Baby Carrier, Inc.* v. *BOBA Inc.*, Case No. 2:15-cv-08946, In the United States District Court for the Central District of California, Jul. 15, 2016, 20 pgs.
Appendix KKK: U.S. Pat. No. 5, 848,741 ("Fair") Invalidity Chart, *The Ergo Baby Carrier, Inc.* v. *BOBA Inc.*, Case No. 2:15-cv-08946, In the United States District Court for the Central District of California, Jul. 15, 2016, 2 pgs.
Appendix L: EP Patent No. 0437365 ("Gunderman") Invalidity Chart, *The Ergo Baby Carrier, Inc.* v. *BOBA Inc.*, Case No. 2:15-cv-08946, In the United States District Court for the Central District of California, Jul. 15, 2016, 14 pgs.
Appendix LL: U.S. Pat. No. 6,257,468 ("Yamazoe") Invalidity Chart, *The Ergo Baby Carrier, Inc.* v. *BOBA Inc.*, Case No. 2:15-cv-08946, In the United States District Court for the Central District of California, Jul. 15, 2016, 4 pgs.
Appendix LLL: Consumer Reports Guide to Baby Products by Sandy Jones, published in 2001 ("Guide to Baby Products") Invalidity Chart, *The Ergo Baby Carrier, Inc.* v. *BOBA Inc.*, Case No. 2:15-cv-08946, In the United States District Court for the Central District of California, Jul. 15, 2016, 8 pgs.
Appendix M: Kwik Sew Pattern No. 1046 ("Kwik Sew") Invalidity Chart, *The Ergo Baby Carrier, Inc.* v. *BOBA Inc.*, Case No. 2:15-cv-08946, In the United States District Court for the Central District of California, Jul. 15, 2016, 18 pgs.
Appendix MM: Baby Matey Literature as Cited on the Face of U.S. Pat. No. 4,986,458 ("Baby Matey Literature") Invalidity Chart, *The Ergo Baby Carrier, Inc.* v. *BOBA Inc.*, Case No. 2:15-cv-08946, In the United States District Court for the Central District of California, Jul. 15, 2016, 20 pgs.
Appendix MMM: U.S. Pat. No. 3,780,919 ("Hansson") Invalidity Chart, *The Ergo Baby Carrier, Inc.* v. *BOBA Inc.*, Case No. 2:15-cv-08946, In the United States District Court for the Central District of California, Jul. 15, 2016, 2 pgs.
Appendix N: Japanese Pub. No. S53-155443 ("The '443 Patent") Invalidity Chart, *The Ergo Baby Carrier, Inc.* v. *BOBA Inc.*, Case No. 2:15-cv-08946, In the United States District Court for the Central District of California, Jul. 15, 2016, 12 pgs.

(56) References Cited

OTHER PUBLICATIONS

Appendix NN: Baby Matey System Invalidity Chart, *The Ergo Baby Carrier, Inc.* v. *BOBA Inc.*, Case No. 2:15-cv-08946, In the United States District Court for the Central District of California, Jul. 15, 2016, 22 pgs.
Appendix NNN: "Physiological Strain Due to Load Carrying" by Michael Holewijn, published in European Journal of Applied Physiology and Occupational Physiology, Feb. 1990 ("Holewijn") Invalidity Chart, *The Ergo Baby Carrier, Inc.* v. *BOBA Inc.*, Case No. 2:15-cv-08946, In the United States District Court for the Central District of California, Jul. 15, 2016, 11 pgs.
Appendix O: Japanese Patent Pub. No. S54-108131 ("The '131 Patent") Invalidity Chart, *The Ergo Baby Carrier, Inc.* v. *BOBA Inc.*, Case No. 2:15-cv-08946, In the United States District Court for the Central District of California, Jul. 15, 2016, 16 pgs.
Appendix OO: Canadian Patent No. 1332928 ("Pettersen") Invalidity Chart, *The Ergo Baby Carrier, Inc.* v. *BOBA Inc.*, Case No. 2:15-cv-08946, In the United States District Court for the Central District of California, Jul. 15, 2016, 16 pgs.
Appendix OOO: Kelty Kangaroo Invalidity Chart, *The Ergo Baby Carrier, Inc.* v. *BOBA Inc.*, Case No. 2:15-cv-08946, In the United States District Court for the Central District of California, Jul. 15, 2016, 4 pgs.
Appendix P: U.S. Pat. No. 4,009,808 ("Sharp") Invalidity Chart, *The Ergo Baby Carrier, Inc.* v. *BOBA Inc.*, Case No. 2:15-cv-08946, In the United States District Court for the Central District of California, Jul. 15, 2016, 5 pgs.
Appendix PP: babyTrekker Instruction Manual copyright date stamped 1998 ("1998 babyTrekker Manual") Invalidity Chart, *The Ergo Baby Carrier, Inc.* v. *BOBA Inc.*, Case No. 2:15-cv-08945, In the United States District Court for the Central District of California, Jul. 15, 2016, 16 pgs.
Appendix PPP: Kirkiliones Invalidity Chart, *The Ergo Baby Carrier, Inc.* v. *BOBA Inc.*, Case No. 2:15-cv-08946, In the United States District Court for the Central District of California, Jul. 15, 2016, 9 pgs.
Appendix Q: UK Patent App. No. GB 2026848 ("David") Invalidity Chart, *The Ergo Baby Carrier, Inc.* v. *BOBA Inc.*, Case No. 2:15-cv-08946, In the United States District Court for the Central District of California, Jul. 15, 2016, 8 pgs.
Appendix QQ: babyTrekker Instruction Manual ("babyTrekker Manual") Invalidity Chart, *The Ergo Baby Carrier, Inc.* v. *BOBA Inc.*, Case No. 2:15-cv-08946, In the United States District Court for the Central District of California, Jul. 15, 2016, 17 pgs.
Appendix QQQ: "Physiological, Biomechanical and Medical Aspects of Soldier Load Carriage" by Joseph Knapik, presented in Jun. 2000 ("Knapik") Invalidity Chart, *The Ergo Baby Carrier, Inc.* v. *BOBA Inc.*, Case No. 2:15-cv-08946, In the United States District Court for the Central District of California, Jul. 15, 2016, 10 pgs.
Appendix R: DIY Baby Sling System Invalidity Chart, *The Ergo Baby Carrier, Inc.* v. *BOBA Inc.*, Case No. 2:15-cv-08946, In the United States District Court for the Central District of California, Jul. 15, 2016, 13 pgs.
Appendix RR: babyTrekker System Invalidity Chart, *The Ergo Baby Carrier, Inc.* v. *BOBA Inc.*, Case No. 2:15-cv-08946, In the United States District Court for the Central District of California, Jul. 15, 2016, 14 pgs.
Appendix RRR: U.S. Pat. No. 4,434,920 ("Moore") Invalidity Chart, *The Ergo Baby Carrier, Inc.* v. *BOBA Inc.*, Case No. 2:15-cv-08946, In the United States District Court for the Central District of California, Jul. 15, 2016, 2 pgs.
Appendix S: Kozy System Invalidity Chart, *The Ergo Baby Carrier, Inc.* v. *BOBA Inc.*, Case No. 2:15-cv-08946, In the United States District Court for the Central District of California, Jul. 15, 2016, 18 pgs.
Appendix SS: First Journey System Invalidity Chart, *The Ergo Baby Carrier, Inc.* v. *BOBA Inc.*, Case No. 2:15-cv-08946, In the United States District Court for the Central District of California, Jul. 15, 2016, 18 pgs.
Appendix SSS: "A Static Biomechanical Load Carriage Model" by R.P. Pelot et al., Presented in Jun. 2000 ("Pelot") Invalidity Chart, *The Ergo Baby Carrier, Inc.* v. *BOBA Inc.*, Case No. 2:15-cv-08946, In the United States District Court for the Central District of California, Jul. 15, 2016, 11 pgs.
Appendix T: Packababy System Invalidity Chart, *The Ergo Baby Carrier, Inc.* v. *BOBA Inc.*, Case No. 2:15-cv-08946, In the United States District Court for the Central District of California, Jul. 15, 2016, 19 pgs.
Appendix TT: French Patent Pub. No. 2794010 ("Ducruet") Invalidity Chart, *The Ergo Baby Carrier, Inc.* v. *BOBA Inc.*, Case No. 2:15-cv-08946, In the United States District Court for the Central District of California, Jul. 15, 2016, 5 pgs.
Appendix TTT: Pony Ride Invalidity Chart, *The Ergo Baby Carrier, Inc.* v. *BOBA Inc.*, Case No. 2:15-cv-08946, In the United States District Court for the Central District of California, Jul. 15, 2016, 4 pgs.
Appendix U: Sakara System Invalidity Chart, *The Ergo Baby Carrier, Inc.* v. *BOBA Inc.*, Case No. 2:15-cv-08946, In the United States District Court for the Central District of California, Jul. 15, 2016, 18 pgs.
Appendix UU: U.S. Pat. No. 4,986,458 ("Linday") Invalidity Chart, *The Ergo Baby Carrier, Inc.* v. *BOBA Inc.*, Case No. 2:15-cv-08946, In the United States District Court for the Central District of California, Jul. 15, 2016, 15 pgs.
Appendix UUU: U.S. Pat. No. 5,114,059 ("Thatcher") Invalidity Chart, *The Ergo Baby Carrier, Inc.* v. *BOBA Inc.*, Case No. 2:15-cv-08946, In the United States District Court for the Central District of California, Jul. 15, 2016, 3 pgs.
Appendix V: Sutemi System Invalidity Chart, *The Ergo Baby Carrier, Inc.* v. *BOBA Inc.*, Case No. 2:15-cv-08946, In the United States District Court for the Central District of California, Jul. 15, 2016, 14 pgs.
Appendix VV: U.S. Pat. No. 4,469,259 ("Krich") Invalidity Chart, *The Ergo Baby Carrier, Inc.* v. *BOBA Inc.*, Case No. 2:15-cv-08946, In the United States District Court for the Central District of California, Jul. 15, 2016, 5 pgs.
Appendix VVV: Weego System Invalidity Chart, *The Ergo Baby Carrier, Inc.* v. *BOBA Inc.*, Case No. 2:15-cv-08946, In the United States District Court for the Central District of California, Jul. 15, 2016, 18 pgs.
Appendix W: Casses Invalidity Chart, *The Ergo Baby Carrier, Inc.* v. *BOBA Inc.*, Case No. 2:15-cv-08946, In the United States District Court for the Central District of California, Jul. 15, 2016, 6 pgs.
Appendix WW: "A Blue-Jean Person Pack" by E.A. Byrnes as published on p. 164 of the May/Jun. 1982 issue of The Mother Earth News ("Byrnes") Invalidity Chart, *The Ergo Baby Carrier, Inc.* v. *BOBA Inc.*, Case No. 2:15-cv-08946, In the United States District Court for the Central District of California, Jul. 15, 2016, 17 pgs.
Appendix WWW: U.S. Pat. No. 6,257,468 ("Yamazoe") Invalidity Chart, *The Ergo Baby Carrier, Inc.* v. *BOBA Inc.*, Case No. 2:15-cv-08946, In the United States District Court for the Central District of California, Jul. 15, 2016, 2 pgs.
Appendix X: U.S. Pat. No. 6,182,873 ("Christopher") Invalidity Chart, *The Ergo Baby Carrier, Inc.* v. *BOBA Inc.*, Case No. 2:15-cv-08946, In the United States District Court for the Central District of California, Jul. 15, 2016, 4 pgs.
Appendix XX: EP Patent No. 0437365 ("Gunderman") Invalidity Chart, *The Ergo Baby Carrier, Inc.* v. *BOBA Inc.*, Case No. 2:15-cv-08946, In the United States District Court for the Central District of California, Jul. 15, 2016, 14 pgs.
Appendix Y: U.S. Pat. No. 6,155,579 ("Eyman") Invalidity Chart, *The Ergo Baby Carrier, Inc.* v. *BOBA Inc.*, Case No. 2:15-cv-08946, In the United States District Court for the Central District of California, Jul. 15, 2016, 4 pgs.
Appendix YY: Kwik Sew Pattern No. 1046 ("Kwik Sew") Invalidity Chart, *The Ergo Baby Carrier, Inc.* v. *BOBA Inc.*, Case No. 2:15-cv-08946, In the United States District Court for the Central District of California, Jul. 15, 2016, 16 pgs.
Appendix Z: U.S. Pat. No. 5,848,741 ("Fair") Invalidity Chart, *The Ergo Baby Carrier, Inc.* v. *BOBA Inc.*, Case No. 2:15-cv-08946, In the United States District Court for the Central District of California, Jul. 15, 2016, 4 pgs.

(56) References Cited

OTHER PUBLICATIONS

Appendix ZZ: Japanese Patent Publication No. S53-155443 ("The '443 Patent") Invalidity Chart, *The Ergo Baby Carrier, Inc.* v. *BOBA Inc.*, Case No. 2:15-cv-08946, In the United States District Court for the Central District of California, Jul. 15, 2016, 10 pgs.
Tentative Ruling on Claim Construction, U.S. Pat. Nos. 8,590,757 and 9,022,260, *The Ergo Baby Carrier, Inc.* v. *BOBA Inc.*, Case No. 2:15-cv-08946, In the United States District Court for the Central District of California, Dec. 1, 2016, 11 pgs.
File History for U.S. Trademark Application No. 75/457,187, filed Mar. 25, 1998, 56 pgs.
"Kinderpack Wearing Instructions for Infant Size," <<https://mykinderpack.com/pages/instructions>>, Copyright 2017 Kindercarry, 5 pgs.
"Kinderpack Wearing Instructions for Toddler Size," <<https://mykinderpack.com/pages/instructions>>, Copyright 2017 Kindercarry, 5 pgs.
SSC Instructions, <<http://www.isara.ro/en/content/7-instructiuni-ssc>>, Copyright 2016 ISARA, 12 pgs.
Wrapping instructions Baby Carriers, <<http://www.kokadi.de/en/instruction:_:162.html>>, Copyright 2016 ISARA, 28 pgs.
"The Five Hidden Features of the Yemaya Baby Carrier," <<http://http://blog.cybex-online.com/blog/safety/the-five-hidden-features-of-the-yemaya-baby-carrier/>>, Oct. 13, 2016 ISARA, 7 pgs.
Preliminary Invalidity Contentions, *The Ergo Baby Carrier, Inc.* v. *BOBA Inc.*, Case No. 2:15-cv-08946, In the United States District Court for the Central District of California, Jul. 15, 2016, 18 pgs.
BOBA, Inc.'s First Amended Counterclaims for Declaration of Unenforceability, Invalidity, and Monopolization, *The Ergo Baby Carrier, Inc.* v. *BOBA Inc.*, Case No. 2:15-cv-08946, In the United States District Court for the Central District of California, May 23, 2016, 73 pgs.
Joint Motion to Terminate for Inter Partes Review of U.S. Pat. No. 9,022,260 (IPR2016-01870) and U.S. Pat. No. 8,590,757(IPR2016-01866), 3 pgs.
Office Action for Japanese Patent Application No. 2016-502118, dated Apr. 7, 2017, 9 pgs.
Office Action for U.S. Appl. No. 15/177,114, dated May 31, 2017, 12 pgs.
Office Action for U.S. Appl. No. 15/602,744, dated Aug. 8, 2017, 42 pgs.
Office Action for Korean Patent Application No. 10-2015-7028949, dated Jul. 20, 2017, 20 pgs.
Office Action for U.S. Appl. No. 15/177,114, dated Oct. 3, 2017, 5 pgs.
Office Action for European Patent Application No. 14773586.4, dated Oct. 12, 2017, 5 pgs.
Office Action for Chinese Patent Application No. 201480023993.2, dated Sep. 26, 2017, 5 pgs.
Office Action for U.S. Appl. No. 15/177,114, dated Nov. 3, 2017, 12 pgs.
Office Action for U.S. Appl. No. 15/177,114, dated Feb. 21, 2018, 13 pgs.
Office Action for U.S. Appl. No. 15/916,990, dated May 15, 2018, 5 pgs.
Office Action for U.S. Appl. No. 15/337,813, dated May 22, 2018, 6 pgs.
Office Action for U.S. Appl. No. 15/177,114, dated May 30, 2018, 5 pgs.
International Preliminary Report on Patentability and Written Opinion for PCT/US2016/59534, dated May 1, 2018, 6 pgs.
Office Action for U.S. Appl. No. 15/094,515, dated Jun. 28, 2018, 15 pgs.
European Search Report for European Patent Application No. 16777348.0, dated Oct. 4, 2018, 10 pgs.
Notice of Allowance for U.S. Appl. No. 15/337,813, dated Nov. 5, 2018, 2 pgs.
Office Action for U.S. Appl. No. 16/204,581, dated Jan. 25, 2019, 5 pgs.
International Search Report and Written Opinion for International Patent Application No. PCT/US17/58820, dated Jan. 5, 2018, 12 pgs.
Office Action for U.S. Appl. No. 15/796,422, dated Nov. 26, 2018, 18 pgs.
Notice of Allowance for U.S. Appl. No. 15/337,813, dated Feb. 14, 2019, 2 pgs.
Office Action for U.S. Appl. No. 15/094,515, dated Feb. 19, 2019, 15 pgs.
Office Action for Japanese Patent Application No. 2017-552901 (with English translation), dated Feb. 19, 2019, 9 pgs.
Notice of Allowance for U.S. Appl. No. 15/796,422, dated Mar. 27, 2019, 7 pgs.
International Preliminary Report on Patentability (IPRP) for International Application No. PCT/US2017/058820, dated May 9, 2019, 11 pgs.
Corrected Notice of Allowability for U.S. Appl. No. 15/796,422, dated May 30, 2019, 6 pgs.
Notice of Allowance for U.S. Appl. No. 15/337,813, dated Jul. 1, 2019, 2 pgs.
Extended European Search Report for European Patent Application No. 16860977.4, dated Jun. 5, 2019, 7 pgs.
Office Action for Korean Patent Application No. 10-2018-7015023, dated Dec. 17, 2019, 5 pgs.
International Search Report and Written Opinion for International Patent Application No. PCT/US19/063052, 11 pgs.
Notice of Allowance for U.S. Appl. No. 15/796,422, dated Apr. 20, 2020, 4 pgs.
Notice of Allowance (with English translation) for Korean Patent Application No. 10-2018-7015023, dated Jul. 9, 2020, 10 pgs.
Extended European Search Report for European Patent Application No. 17864576.8, dated Feb. 14, 2020, 7 pgs.
Initial Determination on Violation of Section 337 and Recommended Determination on Remedy and Bond, In re Matter of Certain Child Carriers, United States International Trade Commission, Inv. No. 337-TA-1154, Mar. 10, 2020, 210 pgs.
Exhibit RX-0116, In re Matter of Certain Child Carriers, United States International Trade Commission, Inv. No. 337-TA-1154, Photographs Embedded in McKibbon Declaration, Exhibit 3 to Depo of McKibbon, 2 pgs.
Exhibit RX-0118, In re Matter of Certain Child Carriers, United States International Trade Commission, Inv. No. 337-TA-1154, Photographs Embedded in McKibbon Declaration, Exhibit 4 to Depo of McKibbon, 1 pg.
Exhibit RX-0120, In re Matter of Certain Child Carriers, United States International Trade Commission, Inv. No. 337-TA-1154, Flickr Photos of Petals and Puddles, Exhibit 5 to Depo of McKibbon, 3 pgs.
Exhibit RX-0123, In re Matter of Certain Child Carriers, United States International Trade Commission, Inv. No. 337-TA-1154: Photo of carrier, Exhibit 7 to Depo of McKibbon, 1 pg.
Exhibit RX-0133, In re Matter of Certain Child Carriers, United States International Trade Commission, Inv. No. 337-TA-1154, Etsy Pages for petalsandpuddles, Exhibit 82 to Depo of Wick, 4 pgs.
Exhibit RX-0135, In re Matter of Certain Child Carriers, United States International Trade Commission, Inv. No. 337-TA-1154, Wayback Machine Page for Etsy search results baby sling, Exhibit 83 to Depo of Wick, Aug. 19, 2010, 4 pgs.
Exhibit RX-0159, In re Matter of Certain Child Carriers, United States International Trade Commission, Inv. No. 337-TA-1154, Ergobaby Omni 360 Cool Air Mesh Instruction Manual, 26 pgs.
Exhibit RX-0160, In re Matter of Certain Child Carriers, United States International Trade Commission, Inv. No. 337-TA-1154, Ergobaby Omni 360 Instruction Manual, 26 pgs.
Exhibit RX-0161, In re Matter of Certain Child Carriers, United States International Trade Commission, Inv. No. 337-TA-1154, Ergobaby Adapt Instruction Manual, 23 pgs.
Exhibit RX-0163, In re Matter of Certain Child Carriers, United States International Trade Commission, Inv. No. 337-TA-1154, Ergobaby 360 Bundle of Joy Instruction Manual, 26 pgs.

(56) References Cited

OTHER PUBLICATIONS

Exhibit RX-0200, In re Matter of Certain Child Carriers, United States International Trade Commission, Inv. No. 337-TA-1154, Declaration of Di Linh Reichman Regarding the Hibiscus Carrier, Sep. 2, 2019, 6 pgs.
Exhibit RX-0206, In re Matter of Certain Child Carriers, United States International Trade Commission, Inv. No. 337-TA-1154, Color Photograph (Respondent Exhibit), Exhibit 301 to Depo of Reichman, 1 pg.
Exhibit RX-0208, In re Matter of Certain Child Carriers, United States International Trade Commission, Inv. No. 337-TA-1154, Color Photograph (Respondent Exhibit), Exhibit 302 to Depo of Reichman, 1 pg.
Exhibit RX-0210, In re Matter of Certain Child Carriers, United States International Trade Commission, Inv. No. 337-TA-1154, Color Photograph (Respondent Exhibit), Exhibit 303 to Depo of Reichman, 1 pg.
Exhibit RX-0212, In re Matter of Certain Child Carriers, United States, International Trade Commission, Inv. No. 337-TA-1154, Color Photograph (Respondent Exhibit), Exhibit 304 to Depo of Reichman, 1 pg.
Exhibit RX-0214, In re Matter of Certain Child Carriers, United States International Trade Commission, Inv. No. 337-TA-1154, Color Photograph (Respondent Exhibit), Exhibit 305 to Depo of Reichman, 1 pg.
Exhibit RX-0216, In re Matter of Certain Child Carriers, United States International Trade Commission, Inv. No. 337-TA-1154, Color Photograph (Respondent Exhibit), Exhibit 306 to Depo of Reichman, 1 pg.
Exhibit RX-0218, In re Matter of Certain Child Carriers, United States International Trade Commission, Inv. No. 337-TA-1154, Color Photograph (Respondent Exhibit), Exhibit 307 to Depo of Reichman, 1 pg.
Exhibit RX-0231, In re Matter of Certain Child Carriers, United States International Trade Commission, Inv. No. 337-TA-1154, Declaration of Kristin Dybvig-Pawelko regarding the No Tie Mei Tai Hibiscus Child Carrier Exhibit 7 to Depo of Dr. Dybwig-Pawelko, Sep. 28, 2019, 9 pgs.
Exhibit RX-0235, In re Matter of Certain Child Carriers, United States International Trade Commission, Inv. No. 337-TA-1154, Color Photograph labeled A (Respondent Exhibit), Exhibit 320 to Depo of Dr. Dybwig-Pawelko, 1 pg.
Exhibit RX-0237, In re Matter of Certain Child Carriers, United States International Trade Commission, Inv. No. 337-TA-1154, Color Photograph labeled B (Respondent Exhibit), Exhibit 320 to Depo of Dr. Dybwig-Pawelko, 1 pg.
Exhibit RX-0239, In re Matter of Certain Child Carriers, United States International Trade Commission, Inv. No. 337-TA-1154, Color Photograph labeled C (Respondent Exhibit), Exhibit 320 to Depo of Dr. Dybwig-Pawelko, 1 pg.
Exhibit RX-0240, In re Matter of Certain Child Carriers, United States International Trade Commission, Inv. No. 337-TA-1154, Color Photograph labeled D (Respondent Exhibit), Exhibit 320 to Depo of Dr. Dybwig-Pawelko, 1 pg.
Exhibit RX-0241, In re Matter of Certain Child Carriers, United States International Trade Commission, Inv. No. 337-TA-1154, Omni Alternate Preliminary—for Review Only (PowerPoint) 10 pgs.
Exhibit RX-0242, In re Matter of Certain Child Carriers, United States International Trade Commission, Inv. No. 337-TA-1154, Color Photograph labeled E (Respondent Exhibit), Exhibit 320 to Depo of Dr. Dybwig-Pawelko, 1 pg.
Exhibit RX-0280, In re Matter of Certain Child Carriers, United States International Trade Commission, Inv. No. 337-TA-1154, TheBabyWearer post about carriers for facing out and referencing both Silly Goose and Pikkolo, Oct. 22, 2007, 9 pgs.
Exhibit RX-0289, In re Matter of Certain Child Carriers, United States International Trade Commission, Inv. No. 337-TA-1154, Pikkolo physical carrier and packaging, 12 pgs.
Exhibit RX-0296, In re Matter of Certain Child Carriers, United States International Trade Commission, Inv. No. 337-TA-1154, Tula Free-to-Grow Carrier Instruction Manual, 25 pgs.
Exhibit RX-0297, In re Matter of Certain Child Carriers, United States International Trade Commission, Inv. No. 337-TA-1154, Tula Explore Carrier Instruction Manual, 8 pgs.
Exhibit RX-0341, In re Matter of Certain Child Carriers, United States International Trade Commission, Inv. No. 337-TA-1154, Infantino Flip 4-in-1 Carrier Design Drawings, Sep. 21, 2017, 12 pgs.
Exhibit RX-0342, In re Matter of Certain Child Carriers, United States International Trade Commission, Inv. No. 337-TA-1154, Infantino Flip 4-in-1 Carrier Product Manual, 2 pgs.
Exhibit RX-0343, In re Matter of Certain Child Carriers, United States International Trade Commission, Inv. No. 337-TA-1154, Infantino Upscale Carrier Product Manual, 2016, 10 pgs.
Exhibit RX-0344, In re Matter of Certain Child Carriers, United States International Trade Commission, Inv. No. 337-TA-1154, Infantino Upscale Carrier Product Manual RX, 2016, 10 pgs.
Exhibit RX-0347, In re Matter of Certain Child Carriers, United States International Trade Commission, Inv. No. 337-TA-1154, Infantino Go Forward Evolved Product Manual, 24 pgs.
Exhibit RX-0351, In re Matter of Certain Child Carriers, United States International Trade Commission, Inv. No. 337-TA-1154, Photograph of Michelle McEntire and Children, Feb. 17, 2008, 1 pg.
Exhibit RX-0402, In re Matter of Certain Child Carriers, United States International Trade Commission, Inv. No. 337-TA-1154, Web Archive Hibiscus Baby Wearing Instructions, 2007, 3 pgs.
Exhibit RX-0411, In re Matter of Certain Child Carriers, United States International Trade Commission, Inv. No. 337-TA-1154, The Cat Bird Baby Website Printout—Our Booth at the ABC Kids Expo in Las Vegas, Sep. 13, 2007, 5 pgs.
Exhibit RX-0413, In re Matter of Certain Child Carriers, United States International Trade Commission, Inv. No. 337-TA-1154, The Cat Bird Baby Website Printout—Pikkolo, a Mei Tai-Like Buckle Carrier, Aug. 2, 2007, 5 pgs.
Exhibit RX-0415, In re Matter of Certain Child Carriers, United States International Trade Commission, Inv. No. 337-TA-1154, Pikkolo Carrier Design Drawings, Jul. 2007, 1 pg.
Exhibit RX-0417, In re Matter of Certain Child Carriers, United States International Trade Commission, Inv. No. 337-TA-1154, Cat Bird Baby Purchase Order, Sep. 25, 2007, 1 pg.
Exhibit RX-0419, In re Matter of Certain Child Carriers, United States International Trade Commission, Inv. No. 337-TA-1154, Sales Receipt for Pikkolo Carrier, Sep. 14, 2007, 4 pgs.
Exhibit RX-0437, In re Matter of Certain Child Carriers, United States International Trade Commission, Inv. No. 337-TA-1154, FlickR Page Printout, Sep. 19, 2008, 2 pgs.
Exhibit RX-0480, In re Matter of Certain Child Carriers, United States International Trade Commission, Inv. No. 337-TA-1154, FlickR Photograph of Closet with Different Types of Material, Apr. 30, 2008, 3 pgs.
Exhibit RX-0482, In re Matter of Certain Child Carriers, United States International Trade Commission, Inv. No. 337-TA-1154, FlickR Photograph of Closet with Different Types of Material, Apr. 30, 2008, 2 pgs.
Exhibit RX-0484, In re Matter of Certain Child Carriers, United States International Trade Commission, Inv. No. 337-TA-1154, FlickR Photograph of crafting supplies, Apr. 30, 2008, 2 pgs.
Exhibit RX-0504, In re Matter of Certain Child Carriers, United States International Trade Commission, Inv. No. 337-TA-1154, Exhibit A to Declaration of Joline Sikora, Jul. 10, 2007, 1 pg.
Exhibit RX-0505, In re Matter of Certain Child Carriers, United States International Trade Commission, Inv. No. 337-TA-1154, Exhibit B to Declaration of Joline Sikora, Jul. 11, 2007, 3 pgs.
Exhibit RX-0506, In re Matter of Certain Child Carriers, United States International Trade Commission, Inv. No. 337-TA-1154, Exhibit C to Declaration of Joline Sikora, Jul. 11, 2007, 3 pgs.
Exhibit RX-0507, In re Matter of Certain Child Carriers, United States International Trade Commission, Inv. No. 337-TA-1154, Exhibit D to Declaration of Joline Sikora, Sep. 18, 2007, 1 pg.

(56) References Cited

OTHER PUBLICATIONS

Exhibit RX-0508, In re Matter of Certain Child Carriers, United States International Trade Commission, Inv. No. 337-TA-1154, Exhibit E to Declaration of Joline Sikora, Sep. 18, 2007, 1 pg.
Exhibit RX-0509, In re Matter of Certain Child Carriers, United States International Trade Commission, Inv. No. 337-TA-1154, Exhibit F to Declaration of Joline Sikora, Sep. 18, 2007, 1 pg.
Exhibit RX-0510, In re Matter of Certain Child Carriers, United States International Trade Commission, Inv. No. 337-TA-1154, Exhibit G to Declaration of Joline Sikora, Sep. 18, 2007, 1 pg.
Exhibit RX-0512, In re Matter of Certain Child Carriers, United States International Trade Commission, Inv. No. 337-TA-1154, Exhibit I to Declaration of Joline Sikora, 2007), 3 pgs.
Exhibit RX-0513, In re Matter of Certain Child Carriers, United States International Trade Commission, Inv. No. 337-TA-1154, Exhibit J to Declaration of Joline Sikora, 1 pg.
Exhibit RX-0514, In re Matter of Certain Child Carriers, United States International Trade Commission, Inv. No. 337-TA-1154, Exhibit K to Declaration of Joline Sikora, 2007, 1 pg.
Exhibit RX-0515, In re Matter of Certain Child Carriers, United States International Trade Commission, Inv. No. 337-TA-1154, Exhibit L to Declaration of Joline Sikora, Feb. 17, 2008, 4 pgs.
Exhibit RX-0520, In re Matter of Certain Child Carriers, United States International Trade Commission, Inv. No. 337-TA-1154, Exhibit Q to Declaration of Joline Sikora, Aug. 23, 2007, 2 pgs.
Exhibit RX-0521, In re Matter of Certain Child Carriers, United States International Trade Commission, Inv. No. 337-TA-1154, Exhibit R to Declaration of Joline Sikora, Aug. 23, 2007, 2 pgs.
Exhibit RX-0522, In re Matter of Certain Child Carriers, United States International Trade Commission, Inv. No. 337-TA-1154, Exhibit S to Declaration of Joline Sikora, Feb. 17, 2008, 2 pgs.
Exhibit RX-0523, In re Matter of Certain Child Carriers, United States International Trade Commission, Inv. No. 337-TA-1154, Exhibit T to Declaration of Joline Sikora, Feb. 17, 2008, 2 pgs.
Exhibit RX-0524, In re Matter of Certain Child Carriers, United States International Trade Commission, Inv. No. 337-TA-1154, Exhibit U to Declaration of Joline Sikora, Feb. 17, 2008, 2 pgs.
Exhibit RX-0525, In re Matter of Certain Child Carriers, United States International Trade Commission, Inv. No. 337-TA-1154, Exhibit V to Declaration of Joline Sikora, Jul. 21, 2007-Sep. 19, 2008, 64 pgs.
Exhibit RX-0526, In re Matter of Certain Child Carriers, United States International Trade Commission, Inv. No. 337-TA-1154, Exhibit W to Declaration of Joline Sikora, Feb. 27, 2007-Apr. 5, 2009, 41 pgs.
Exhibit RX-0527, In re Matter of Certain Child Carriers, United States International Trade Commission, Inv. No. 337-TA-1154, Exhibit A to Declaration of Mischele McEntire, Feb. 17, 2007, 2 pgs.
Exhibit RX-0528, In re Matter of Certain Child Carriers, United States International Trade Commission, Inv. No. 337-TA-1154, Exhibit B to Declaration of Mischele McEntire, Feb. 17, 2008, 4 pgs.
Exhibit RX-0539, In re Matter of Certain Child Carriers, United States International Trade Commission, Inv. No. 337-TA-1154, LILLEbaby Complete 6 Position Baby Carrier User Manual, Exhibit 613 to Depo of L. Lehan, 16 pgs.
Exhibit RX-0551, In re Matter of Certain Child Carriers, United States International Trade Commission, Inv. No. 337-TA-1154, Silly Goose Photos and thread from babywearer.com, Sep. 14, 2007, 14 pgs.
Exhibit RX-0552, In re Matter of Certain Child Carriers, United States International Trade Commission, Inv. No. 337-TA-1154, Silly Goose Photos and thread from babywearer.com, Oct. 31, 2007, 15 pgs.
Respondent's Pre-Hearing Brief, In re Matter of Certain Child Carriers, United States International Trade Commission, Inv. No. 337-TA-1154, Nov. 8, 2019, 405 pgs.
Respondent's Post-Hearing Initial Brief, In re Matter of Certain Child Carriers, United States International Trade Commission, Inv. No. 337-TA-1154, Jan. 6, 2020, 102 pgs.
Respondent's Post-Hearing Responsive Brief, In re Matter of Certain Child Carriers, United States International Trade Commission, Inv. No. 337-TA-1154, Jan. 28, 2020, 127 pgs.
Commission Investigative Staff's Pre-Hearing Brief In re Matter of Certain Child Carriers, United States International Trade Commission, Inv. No. 337-TA-1154, Nov. 20, 2019, 195 pgs.
Commission Investigative Staff's Initial Post-Hearing Brief In re Matter of Certain Child Carriers, United States International Trade Commission, Inv. No. 337-TA-1154, Jan. 13, 2020, 124 pgs.
Commission Investigative Staff's Reply Post-Hearing Brief In re Matter of Certain Child Carriers, United States International Trade Commission, Inv. No. 337-TA-1154, Jan. 22, 2020, 26 pgs.
Complainant's Pre-Hearing Brief, In re Matter of Certain Child Carriers, United States International Trade Commission, Inv. No. 337-TA-1154, Nov. 21, 2019, 852 pgs.
Complainant's Post-Hearing Initial Brief, In re Matter of Certain Child Carriers, United States International Trade Commission, Inv. No. 337-TA-1154, Jan. 6, 2020, 147 pgs.
Complainant's Post-Hearing Responsive Brief, In re Matter of Certain Child Carriers, United States International Trade Commission, Inv. No. 337-TA-1154, Jan. 17, 2020, 85 pgs.
Notice of Commission Determination to Review in Part a Final Initial Determination Finding No Violation of Section 337; Termination of the Investigation, 85 Federal Register 95, at 29484-29485, May 15, 2020, 2 pgs.
Office Action (with English translation) for Chinese Patent Application No. 201680071536.X, dated Nov. 16, 2020, 16 pgs.
Office Action (with English translation) for Korean Patent Application No. 10-2018-7015023, dated Dec. 17, 2019, 10 pgs.
Office Action for Japanese Patent Application No. 2018-521974 dated Aug. 14, 2020, 2 pgs.
Office Action issued for Korean Patent Application No. 10-2020-7029046, dated Oct. 22, 2020, 11 pages.
Examination Report issued for European Patent Application No. 17864576.8, dated Nov. 16, 2020, 5 pages.
Office Action for Japanese Patent Application No. 2020-060090, dated Feb. 19, 2021, 1 pg.
Notice of Allowance for U.S. Appl. No. 16/682,288, dated Mar. 2, 2021, 3 pgs.
Office Action for U.S. Appl. No. 16/694,641, dated Mar. 17, 2021, 17 pgs.
Moriguchi Yuko, JP-2014176494A, Google translation, Sep. 2014, 14 pgs.
Office Action with English translation for Chinese Patent Application No. 201680071536.X, dated Apr. 7, 2021, 18 pgs.
Notice of Allowance for U.S. Appl. No. 16/682,288, dated Apr. 26, 2021, 3 pgs.

ADJUSTABLE CHILD CARRIER

RELATED APPLICATIONS

This application is a continuation of, and claims a benefit of priority under 35 U.S.C. 120 from, U.S. patent application Ser. No. 15/337,813 filed Oct. 28, 2016, entitled "ADJUSTABLE CHILD CARRIER," now issued as U.S. Pat. No. 10,426,275, which claims the benefit of priority under 35 USC § 119(e) to U.S. Provisional Patent Application No. 62/248,745 by Rodney Telford, filed Oct. 30, 2015 and entitled "Baby Carrier," of which the entire contents are incorporated herein by reference.

TECHNICAL FIELD

The present disclosure relates to child carriers. Even more particularly, the present disclosure relates to a child carrier that is adaptable to ergonomically carry a child as the child grows.

BACKGROUND

Various child carriers are currently available for transporting a child by a parent or other individual. Child carriers have become popular for carrying infants and toddlers because they afford the wearer freedom of hand and arm movement while carrying a child. In pursuit of child safety, some of these devices have become overly complex involving, among other things, rigid seats and frames which considerably increase the weight of the carrier and cannot accommodate for the growth of the child. These complex carriers are relatively heavy and place an undue strain upon the wearer, particularly in the lumbar region. In addition, because of the size of many of the present day carriers, they can only be worn on the back thus denying the child the comfort and security of a position where a child and its mother may be in a face-to-face relationship.

Soft structured carriers have become increasingly popular because they are lighter, less cumbersome and more comfortable to wear. These carriers incorporate padding, stitching and fabrics, rather than a rigid frame, to provide the structure. However, some soft-structured carriers hold a child in an upright position with the child's legs hanging down and the base of the child's spine supporting the child's bodyweight. This position may not be optimal for infants and other young children. While an adult spine has four curves, a young child's spine only has two curves. A majority of a young child's spine will form a C-shape (so-called total kyphosis). Positioning a young child, particularly an infant, in an upright position may unduly limit curvature of the spine and puts stress on the infant's sacrum. This can cause the infant's pelvis to tilt backward, limiting leg and hip movement, which may impede healthy development of the infant's pelvis.

Moreover, conventional soft structured carriers are usually designed for a very limited age, weight and size of child and make compromises regarding the shape of the carrier to accommodate a range of ages. Even if a carrier supports ergonomic positioning of the child at one age/weight/size, positioning a child in an ergonomic position through the range of ages while utilizing the same carrier poses a problem as different children develop at different rates and the anatomy and physiology of children changes dramatically between infancy and toddlerhood.

A carrier designed for infants or younger babies may not accommodate a child as the child grows into toddlerhood because the seat and back support portions of the carrier will become too small. In an attempt to make carriers more adaptable, some carriers provide additional panels that can be unfolded and added to the seat to widen the seat and/or back panels that can expand (e.g., by unfolding additional back panel material or attaching new panels) to accommodate the child's growth. However, simply widening the seat or lengthening the carrier does not adequately address proper ergonomics.

On the other hand, a carrier designed for older children may not properly support an infant. One solution to this problem is the use of a specially designed "infant insert." In general, an infant insert is an accessory that incorporates additional padding and structure and makes it possible to carry a small infant in a carrier that would not otherwise properly support the infant. However, not all carriers support the use of infant inserts. Moreover, depending on design, infant inserts may be cumbersome, non-intuitive, and easily lost. In particular, the use of a separate infant insert may require that parents keep track of two separate devices and may significantly increase the difficulty of configuring the carrier for a wearer, the wearing of the carrier, or the ingress and egress of a child to the carrier.

Due to the foregoing issues, parents often opt for changing carriers as the child ages.

SUMMARY

Embodiments described herein provide a wearable child carrier that can be adapted to a baby's size and provide ergonomic positioning of the child throughout the range of the carrier adjustability.

According to one embodiment, a child carrier includes a waist belt adapted for securing about a wearer's hips and a main body coupled to the waist belt, where the main body adapted to form a child carrying area in cooperation with a wearer's torso. The main body can include a torso support portion configured for supporting at least the torso of a child; and an adjustable bucket seat configurable in a plurality of bucket seat configurations, each of the plurality of bucket seat configurations having a different bucket seat depth and bucket seat width and adapted to support a child in a corresponding size range in a spread squat position. In one embodiment, the plurality of bucket seat configurations comprises a configuration adapted to support an infant in a spread squat position without an infant insert. The plurality of bucket seat configurations may include a configuration adapted to support a toddler in a spread squat position.

The child carrier can include one or more adjustment areas adapted to adjust the bucket seat depth and the bucket seat width. In one embodiment, the child carrier has a minimum wearable height that is dependent on the bucket seat depth.

In accordance with one aspect, the plurality of bucket seat configurations comprises a first configuration adapted to support a child in a first size range in a first spread squat position; and a second configuration adapted to support a child in a second size range in a second spread squat position. The first configuration may have a first bucket seat width and first bucket seat depth and the second configuration may have a second bucket seat width and a second bucket seat depth, wherein the first bucket seat width is less than the second bucket seat width and the first bucket seat depth is greater than the second seat bucket depth.

In one embodiment, the main body further comprises a seat center portion coupled to the waist belt and torso support portion and thigh supports disposed on either side of the seat center portion. The thigh supports can be adapted to pass under and support a child's thighs and cooperate with the seat center portion to form the bucket seat. The carrier can further include a base width adjuster coupled to each thigh support. The base width adjusters can be configured for selective coupling to the waist belt in multiple locations to adjust a width of the main body at the waist belt. The base width adjusters can also be configured for selective coupling to the waist belt in multiple locations to adjust the bucket seat depth.

The child carrier may include one or more fabric shaping members adapted to control a bulge of the bucket seat. As one example, the fabric shaping members may comprise darts disposed between the thigh supports and the seat center portion, where the darts are adapted to open or close responsive to adjustment of the base width adjusters. The base width adjusters may be configurable in a first setting corresponding to a maximum bucket seat depth and a second setting corresponding to a minimum bucket seat depth, wherein the darts or other fabric shaping members have a first shape corresponding to the first setting and a second shape corresponding to the second setting.

In accordance with one embodiment, the seat center portion comprises laterally outer edges and the thigh supports comprise laterally inner edges. The fabric shaping members may be disposed between the laterally outer edges and the laterally inner edges. The base width adjusters can be adjustable through rotation to rotate the laterally inner edges relative to the laterally outer edges to open or close the fabric shaping members. Furthermore, adjusting the base width adjusters can increase or decrease the bucket depth/shape.

The carrier may further include thigh width adjusters comprising thigh width adapters coupled to the thigh supports where the thigh width adapters can adjust the width of the bucket seat.

The carrier may also include a neck support configurable in an inside folded down position in which the neck support is positioned in the child carrying area to support a child's neck. The neck support may also be configured in an extended position to provide additional carrier length and support for a larger child, or additional neck support and coverage for a sleeping baby. The neck support may also be configurable in an outside folded down position.

According to one embodiment, a method of configuring a child carrier can comprise: for a child to be carried, adjusting a bucket seat of the child carrier to a child's size and positioning the child in a child carrying area of the child carrier such that the child is supported in an ergonomic spread squat position. Adjusting the bucket seat to the child's size can include configuring a depth of the bucket seat by coupling base width adjusters of the child carrier to a waist belt of the child carrier at positions for a base width setting corresponding to the child's size and adjusting thigh width adapters to adjust a width of the bucket seat. Configuring the depth the bucket seat may further comprise rotating the base width adjusters to open or close darts. The method may further include configuring an adjustable neck support to fill a portion of the child carrying area and support a child's neck.

Embodiments described herein provide an advantage over prior carriers because the ergonomic bucket seat gradually adjusts to a growing baby from newborn to toddler, to ensure baby is seated in an ergonomic spread-squat, natural "M shape" position at multiple stages.

As an additional advantage, embodiments described herein can provide an adjustable seat shape that does not require adding to or removing structure from the carrier to change the seat shape. For example, some embodiments can accommodate infants and larger children without requiring an infant insert for an infant.

Embodiments described herein can provide another advantage by allowing for easy adjustment of the carrier seat shape without adding or removing panels from the seat.

Embodiments described herein can provide another advantage by providing a carrier with a wearable length that can be adjusted without requiring complicated mechanisms to extend the overall length of the carrier.

BRIEF DESCRIPTION OF THE DRAWINGS

For a better understanding of these and other objects of the invention, reference will be made to the following detailed description of the invention which is to be read in association with the accompanying drawings, wherein.

DETAILED DESCRIPTION

Figure 1:
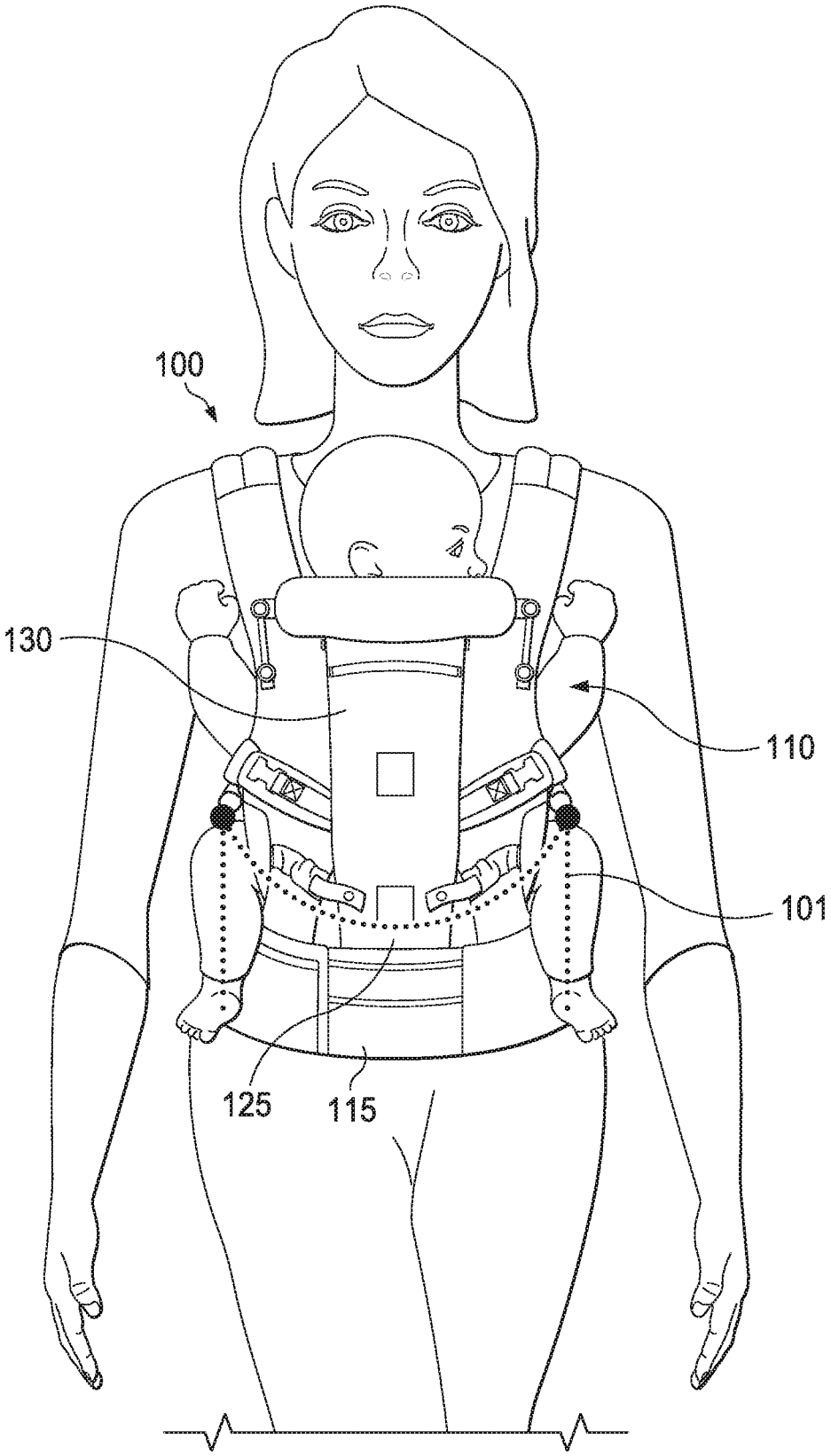
FIG. 1 is a diagrammatic representation of an adult wearer carrying a child in an adjustable carrier.

Child carriers and related methods and the various features and advantageous details thereof are explained more fully with reference to the nonlimiting embodiments that are illustrated in the accompanying drawings and detailed in the following description. Descriptions of well-known starting materials, processing techniques, components and equipment are omitted so as not to unnecessarily obscure the invention in detail. It should be understood, however, that the detailed description and the specific examples, while indicating preferred embodiments of the invention, are given by way of illustration only and not by way of limitation. Various substitutions, modifications, additions and/or rearrangements within the spirit and/or scope of the underlying inventive concept will become apparent to those skilled in the art from this disclosure.

The present disclosure relates to child carriers that allow a child, including an infant, to be carried in a manner that supports the child and maintains the child's pelvis and thighs in a preferred ergonomic position through a range of ages. In particular, embodiments described herein provide carriers that support the child's bottom, pelvis and thighs in a desired position. Embodiments described herein also allow a child to be carried on the front or back or to the side of the person carrying the child. The carrier can be worn by a user in front of, in back of or to the side of the wearer with the child's weight carried near the wearer's center of gravity and close to the wearer's front, back or side in a front, back or side position, respectively.

The adjustable child carrier can be configured to accommodate children of a wide range of sizes in a front, rear or side carrying position while supporting the child's hips, pelvis, bottom and both upper thighs when the child is being carried in various orientations. For example, embodiments of a child carrier as disclosed herein may provide an adjustable child carrier usable with a newborn child (infant) (e.g., around 7 pounds) and additionally with children all the way to up to around 45 pounds or more.

In accordance with one aspect of the present disclosure, a carrier includes a bucket seat for a child and one or more adjustment areas that when adjusted serve to adjust a depth of the seat bucket and a height of the child carrier. When adjusted to a newborn setting, the carrier is configured such that the depth of the seat bucket may be at a maximum. Conversely, when adjusted to its maximum, or largest size, setting (e.g., a setting for the largest child the carrier is designed to accommodate) the depth of the seat bucket may be at a minimum. When the depth of the bucket seat is at a maximum the thighs may be supported such that the angle of the thighs of the child relative to the coronal plane may be greatest and when the depth of the bucket seat is at a minimum the thighs may be supported such that the angle of the thighs of the child relative to the coronal plane may be the smallest. Similarly, then, the bucket seat is at a maximum, the carrier may be configured such that the carrier maintains a child carried therein with relatively more curve in their spine than when the bucket seat is at a minimum depth.

A child carrier may include one or more adjustment points that work alone or in cooperation to adjust the shape of the bucket seat area provided by the child carrier. These adjustment points may include base width adjusters adapted to adjust the width of the main panel of the baby carrier at a point where the main panel is coupled to the waistband of the carrier. The adjustment of the width of the base of the main panel may serve to provide maximum shape for the bucket area and thus maximum depth of the bucket seat area when adjusted to the narrowest setting for newborn babies and the minimal depth of the bucket seat area for the largest children when adjusted to the widest setting.

Another adjustment point provided by embodiments may be thigh width adjusters. These thigh width adjusters are configured to adjust the width of the main panel of the baby carrier at a point in the main panel configured to accommodate the thighs of a child. The thigh width of the main panel may be smallest at the tightest or smallest setting of the thigh width adjusters for newborn babies and widest at its largest or loosest setting (which may be fully released or not engaged) for the largest children (e.g., that the carrier is designed to accommodate).

These adjustment points may also work in cooperation to adjust the baby carrier. For example, the thigh width adjusters may also serve as more granular adjustment for the bucket area within the range of gross adjustment provided by the base width adjuster.

The carrier of certain embodiments may also be configured to adjust in height. In certain embodiments, the length of the physical carrier from the top edge of the waist belt at the center to the top edge of the carrier at the center remains consistent, however, the wearable height changes depending on the setting of the bucket seat size. With the base width at its smallest/narrowest setting the bucket seat is deeper consuming more of the carrier length measurement, thus leaving less measurement for the wearable height while with the base width at is largest/widest setting the bucket seat is shallow consuming less of the carrier length measurement, thus leaving more measurement for the wearable height.

Embodiments of such carriers may also include an adjustable neck support. Such a neck support or collar that may be positioned according to the direction the child is facing, the size of the child, or other criteria. The adjustable neck support may be rotatable relative to the main panel such that the neck support may be extended increasing the center height of the carrier giving additional back or neck support for a child (depending on the size of the child). The neck support may also be folded back away from the wearer to reduce the height of the carrier (e.g., for non-infant children). The neck support may also be folded down into the carrier toward the wearer such that it may reside inside the child carrying area to give an infant or other child additional head or neck support.

Embodiments as disclosed herein may therefore provide an adjustable child carrier configured to accommodate children of a wide range of sizes in a front, rear or side carrying position. Embodiments may thus be sized appropriately to carry an infant without the use of an additional infant insert. Configured according to such a setting, the carrier may be adapted for placement of a child in a child carrying area of the child carrier with the infant's knees raised. In one embodiment, when adjusted to accommodate an infant the carrier is adapted to support the infant in a position with the infant's femur at an angle of 90-120 degrees from the coronal plane. Additionally, the carrier can be adapted to support the infant in a position with the infant's knees at 45-60 degrees from the median plane. In particular embodiments, the carrier can be adapted to promote a spread-squat-position.

The carrier can be ergonomic for the wearer as well. A padded waist belt may provide lumbar support and may cooperate with shoulder straps (that may attach to the same or opposite sides of the carrier) that can form a configurable harness that can position the carrier in a front, side or back carry position while distributing the weight evenly to the wearer. The carrier may be adjusted such that the child is positioned close to the wearer's center of gravity which distributes the child's weight evenly. In some embodiments, the harness may be adjusted so that a majority of the child's weight is transferred to the wearer's hips.

FIG. 1 is a diagrammatic representation of an adult wearer carrying a child in an adjustable carrier 100. Adjustable carrier comprises a main body 110 coupled to a waist belt 115. Main body 110 includes a torso support portion 130 and a bucket seat 125. The torso support portion 130 is configured for supporting the upper body of the child while in the carrier 100. The seat 125 is configured for supporting the legs, hips and posterior of the child in an ergonomic position. As discussed in more detail below, embodiments of adjustable carrier 100 can include various adjustments such that carrier 100 can be adjusted as the child grows to support the child in an ergonomic spread squat position appropriate for the weight or size of the child with the child's pelvis, bottom and thighs all being supported. In an ergonomic spread squat position (also known as the "frog leg", "frog", "squat spread" or "M" position) (indicated by line 101) the flexion at the hip joint is at least 90° and in some cases is 110° to 120° from the coronal plane, and the spreading angle can average at approximately 45-55° from the median plane. As carrier 100 is adjustable, the angle of the hips and spread can depend on the settings of the carrier 100 and developmental stage of the child.

In one embodiment, the carrier can be adapted to support the child in a position with the child's femur approximately 90° to 120° (or other elevated position) from the coronal plane and to position the child's knees with an amount of spreading. The amount of spreading may depend on the developmental stage of the child and orientation with a newborn having less than 30°, then approximately 30°, then approximately 35°-40° and so on so, such that the final spread is approximately 40°-45°, though other amounts of spreading may be achieved including (e.g., for example approximately 55°). In one embodiment, the spreading may be at least 20° degrees from the median plane. The child's weight can be distributed across the child's bottom, thighs and back so that the sacrum does not bear too much weight and the child can rest with a more naturally curved "C" spine in a spread squat position that is believed to be better for pelvic development. It can be noted, however, that the child can be positioned in any comfortable position, preferably emphasizing a supportive posture rather than a posture where the child is primarily sitting on his or her sacrum.

Figure 2A:
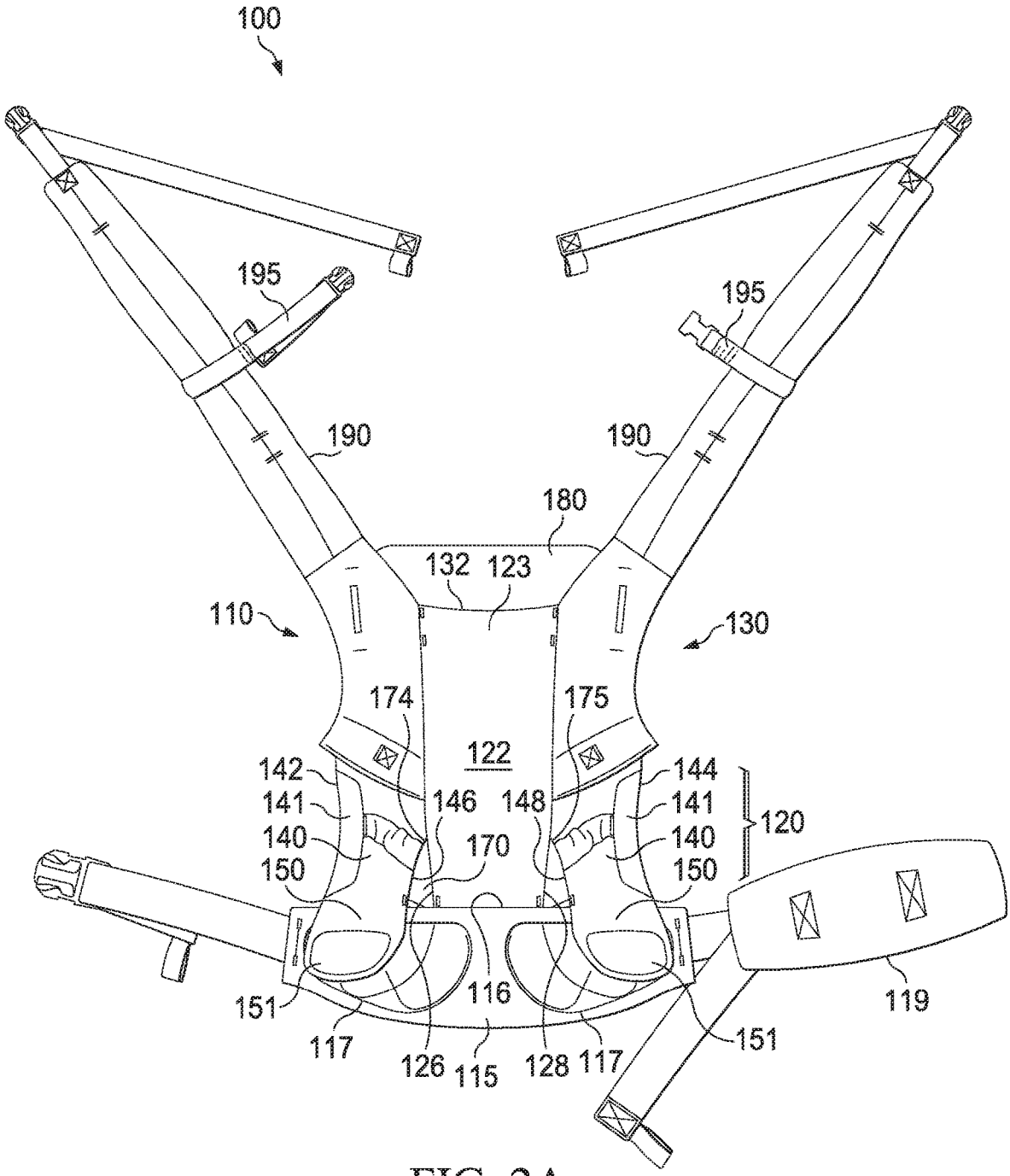
FIG. 2A is a diagrammatic representation of an inside view of one embodiment of an adjustable baby carrier.
Figure 2B:
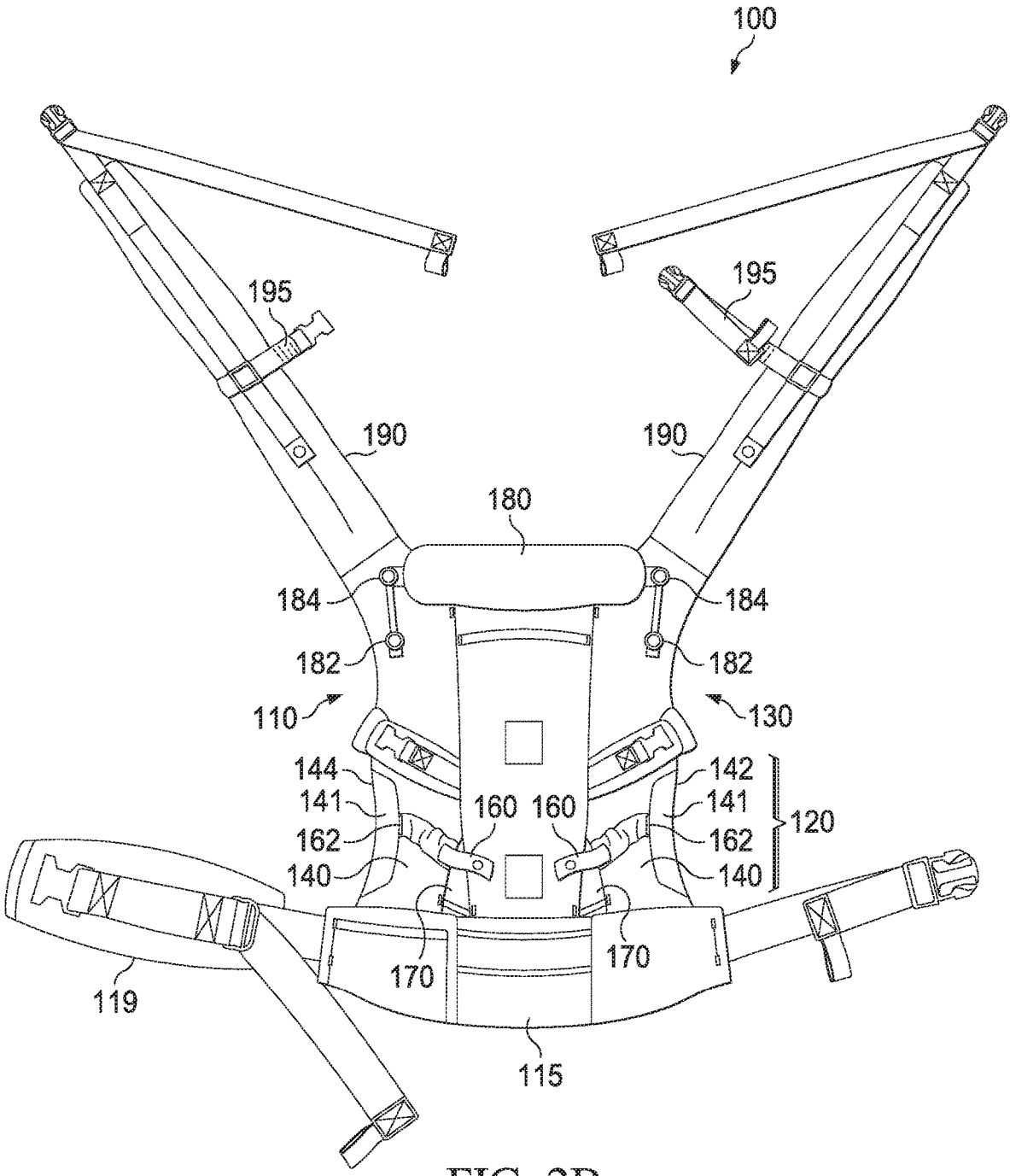
FIG. 2B is a diagrammatic representation of an outside view of one embodiment of adjustable carrier.

FIG. 2A is a diagrammatic representation of an inside view of one embodiment of an adjustable baby carrier 100 and FIG. 2B is a diagrammatic representation of an outside view of one embodiment of adjustable carrier 100 (FIGS. 2A and 2B are referred to collectively herein as FIG. 2). Carrier 100 comprises a main body 110 coupled to a waist belt 115. Main body 110 includes an upper torso support portion 130, a seat portion 120 and thigh support areas 140. Carrier 100 may also include shoulder straps 190 and a chest strap 195. A child can be supported in a child carrying area created by the main body 110 in cooperation with the wearer's torso. Torso support portion 130 is configured to support the upper body of the child while in the carrier while seat portion 120 cooperates with adjustable thigh support areas 140 to form an adjustable bucket seat 125 (FIG. 1) adapted to ergonomically position the child's legs and hips. Waist belt 115 and shoulder straps 190 provide a harness that distributes the child's weight to the wearer. Chest strap 195 can be used to secure left and right shoulder straps together.

Bucket seat portion 120 and thigh support areas 140 are adapted to pass from the outer side of the child carrying area (the side away from the wearer's torso) to inner side to form supportive and adjustable bucket seat 125. Inner end portions of thigh support areas 140 can be selectively coupled to waist belt 115 by base width adjusters 150 that are configurable for adjusting the width and depth of the bucket seat 125. Thigh width adjusters 160 can also be provided to provide additional width adjustment. Thus, the bucket seat 120 can be adjusted to accommodate a range of ages/sizes/weights.

The supportive and adjustable bucket seat 125 can have a generally concave (e.g., "C" shape) inner profile from the inward side to the outward side and from right to left. Seat side edges 142, 144 (formed by the edges of thigh support areas 140) can be higher than the center of the seat and can be spaced such that the side edges pass under and around the child's thighs at a distance from the child's hips such that the child's legs (e.g., above the knee) do not dangle down. In some embodiments, thigh support areas 140 may provide additional support. In particular, in certain embodiments the thigh support areas 140 may include gathers, elastic material or another type of biasing material.

Bucket seat portion 120 comprises a seat center portion 122 that is coupled to waist belt 115 or other portion of carrier 100 at one end and to upper torso support portion 130 at the other end. Seat center portion 122 may be formed from a single piece of material, or may be formed from multiple pieces of material, multiple layers of materials, or multiple materials. The junction between upper torso support portion 130 and seat center portion 122 may be a substantially seamless transition. For example, in one embodiment, a center panel 123 may form seat center portion 122 and an upper torso center panel such that seat center portion 122 and the upper torso center panel comprise a unitary construction of one or more layers of material. In other embodiments, the junction may include seams, edges or other features delineating between upper torso support portion 130 and seat center portion 122.

Thigh support areas 140 are disposed to the left and right of seat center portion 122. Thigh support areas 140 may be selectively coupled to waist belt 115 by base width adjusters 150 such that thigh support areas 140 pass under and around the child's thighs at a distance from the child's hips where the portion of the thigh support areas 140 that pass under and around the child's thighs is higher than the child's bottom so that the child's knees are lifted. The thigh support areas 140 can have sufficient stiffness such that the child's thighs may be encouraged to spread by the thigh support areas 140 or wearer's torso. In one embodiment, thigh support areas 140 provide areas of thigh padding 141 to support the child's thighs.

Base width adjusters 150 may be coupled to respective thigh support areas 140. In one embodiment, base width adjusters 150 may comprise flaps or tabs coupled to thigh support areas 140. In the illustrated embodiment, base width adjusters 150 are coupled to respective thigh support areas 140 by virtue of being part of the same thigh support straps. However, other configurations may also be used. In any event, base width adjusters 150 can be selectively coupled to waist belt 115 to couple thigh support areas 140 of main body 110 to waist belt 115.

Base width adjusters 150 can be used to adjust the width of the base of main body 110 where it connects to waist belt 115. A fastening mechanism 151 of base width adjusters 150, such as a hook and loop material, buttons, snaps, zipper, etc., can cooperate with a corresponding fastening mechanism 117 on waist belt 115 to couple thigh support areas 140 to waist belt 115. The fastening mechanisms 117, 151 are configured such that the base width adjusters 150 may be coupled to the waist belt 115 in multiple positions or throughout a range of positions.

The width of bucket seat 125 proximate to waist belt 115 can be adjusted by changing the position at which base width adjusters 150 are secured to waist belt 115. For example, moving the bottom ends of base width adjusters 150 laterally inboard (rotating base width adjusters 150 inward) decreases the width of main body 110 at the point main body 110 meets waist belt 115 and may serve to decrease the width of the bucket seat where thigh support areas 140 pass under the child's thighs. Moving the ends of base width adjusters 150 more laterally outboard (rotating base width adjusters 150 laterally outward) increases the width of the main body 110 where it is coupled to the waist belt 115 and may increase the bucket seat width where the thigh support areas 140 pass under the child's thighs.

Base width adjusters 150 can be used to control the depth of the bucket seat 125. In a minimum (or narrowest) base width setting the base width adjusters 150 may be fastened to the waist belt 115 such that they are maximally proximate one another toward the center axis of the waist belt 115 (given the range or number of positions possible). In this minimum base width setting carrier 100 is configured such that the depth of the seat bucket 125 may be at a maximum. In a maximum (or widest) base width setting, the base width adjusters 150 may be fastened to the waist belt 115 such that they are maximally distal one another away from the center axis of the waist belt 115 (given the range or number of positions possible). In this maximum (or widest) base width setting, carrier 100 is configured such that the depth of the bucket seat 125 may be at a minimum.

Bucket seat portion 120 may include one or more shaping members to facilitate shaping the bucket seat. In one embodiment, bucket seat portion 120 includes gusset portions 170 that span the gap between the respective inner edges 146, 148 of thigh support areas 140 and the laterally outer edges 126, 128 of seat center portion 122. Gusset portions 170 may be fastened to seat center portion 122 at or proximate to laterally outer edges 126, 128 and to thigh support areas at or proximate to laterally inner edges 146, 148 to form a first dart having a dart apex 174 generally pointing toward the bottom of the bucket seat 125 and dart legs defined by the connections at or proximate to edges 126, 146 and a second dart having a dart apex 175 and dart legs defined by the connections at or proximate to edges 128,148. The dart legs can be closed or opened to gather or release the darts. In particular, by adjusting base width adjusters 150 to decrease the angle between seat center portion 122 and thigh support areas 140, the dart legs can be closed and darts deepened. Consequently, bucket seat 125 can bulge further and take on a deeper curve. Conversely, adjusting base width adjusters 150 to increase the angle between seat center portion 122 and thigh support areas 140 opens the dart legs and makes the darts formed by gusset portions 170 shallower. Consequently, the bucket seat 125 formed by carrier 100 will be shallower. While, in the above embodiment, the shaping members are darts, other shaping mechanisms can be used to control the fullness of bucket seat 125 including, but not limited to pleats, gathers or tucks.

Figure 3A:
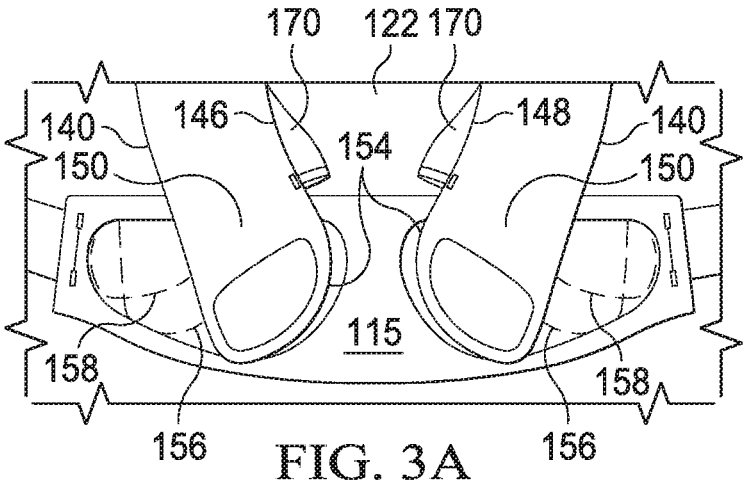
FIG. 3A is a diagrammatic representation of one embodiment of a base width adjuster in a first base width adjuster configuration.
Figure 3B:
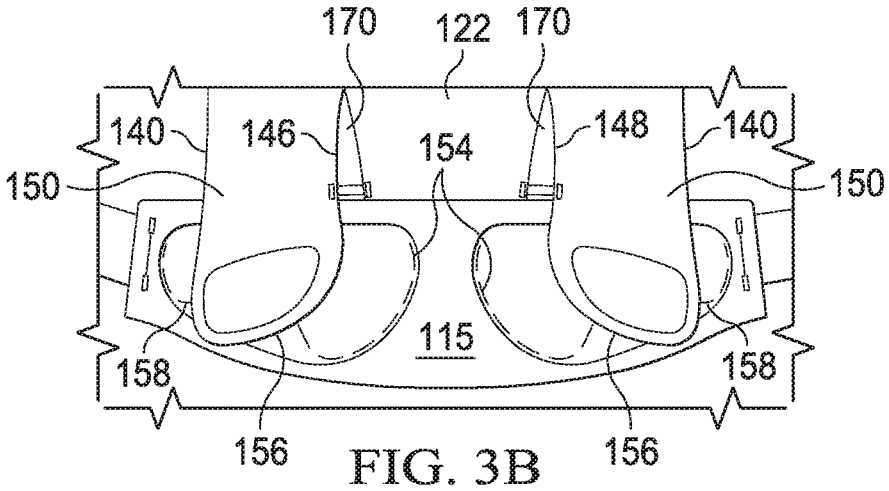
FIG. 3B is a diagrammatic representation of one embodiment of a base width adjuster in a second base width adjuster configuration.
Figure 3C:
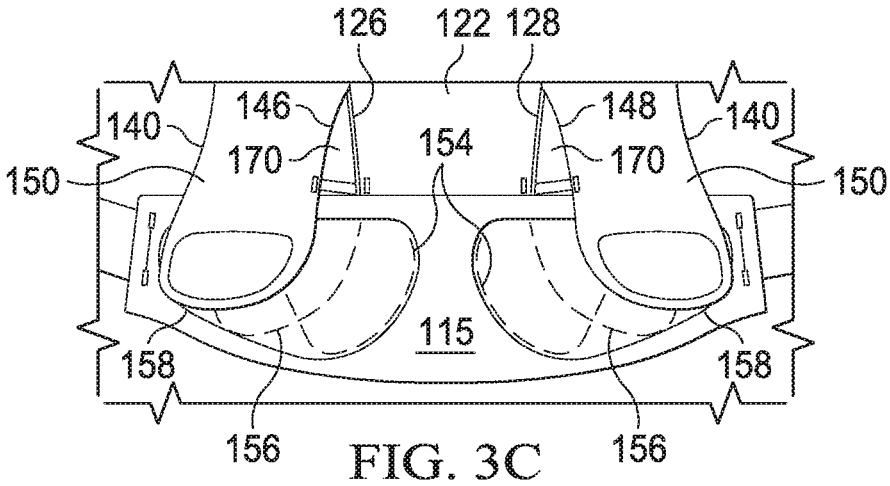
FIG. 3C is a diagrammatic representation of one embodiment of a base width adjuster in a third base width adjuster configuration.

Referring briefly to FIGS. 3A, 3B and 3C (collectively FIG. 3), FIG. 3 illustrates the operation of one embodiment of base width adjusters 150. In FIG. 3, the base width adjusters 150 can be secured to waist belt 115 to either side of the lateral centerline of main body 110 to adjust the width of carrier 100 at thigh support areas 140. In the embodiment illustrated, hook and loop material is used to secure the base width adjusters 150 to waist belt 115 on the side of waist belt 115 sandwiched between waist belt 115 and the wearer. This can increase the hold of the hook and loop material when in use because of the pressure against the base width adjusters 150.

In the embodiment of FIG. 3, each base width adjuster 150 is secured to waist belt 115 in one of three positions 154, 156, 158. These positions may correspond to particular size ranges of children. In FIG. 3A, base width adjusters 150 are secured at positions 154 corresponding to a minimum (or narrowest) base width setting. In FIG. 3B, base width adjusters 150 are secured at positions 156 corresponding to a moderate base width setting. In FIG. 3C, base width adjusters 150 are secured at positions 158 corresponding to a maximum (or widest) base width setting.

It can be noted that base width adjusters 150 as illustrated essentially rotate from a pivot point as they are adjusted. Thus, not only does the lateral position of the attachment position change, the vertical position does as well (e.g., positions 154, 156 and 158 for a base width adjuster 150 are both laterally and vertically displaced from each other). The use of a rotational motion like this provides a greater change in bucket depth for a given lateral change. Other embodiments, however, could use a more linear motion (e.g., in which the attachment positions are horizontally aligned). Furthermore, positions 154, 156 and 158 are provided by way of example. In the embodiment illustrated, base width adjusters 150 can be coupled to fastening mechanism 117 in a continuous range of positions. Other embodiments may provide discrete attachment points.

Referring to FIG. 3A, base width adjusters 150 are fastened to the waist belt 115 such that they are maximally proximate one another toward the center axis of the waist belt 115 (given the range or number of positions possible). However, because laterally inner edges 146, 148 of thigh support areas 140 are drawn close to laterally outer edges 126, 128 (hidden by gusset portion 170) of seat center support part 122, gusset portions 170 form deeply curved darts. Put another way, by fastening base width adjusters 150 to waist belt 115 such that they are maximally proximate one another, the laterally outer edges of gusset portions 170 may be drawn toward the laterally inner edges of gusset portions 170, creating a corresponding greater curve or dart shapes in gusset portions 170. This serves to shape bucket seat portion 120 to increase the depth of the bucket seat portion.

Referring to FIG. 3C, the base width adjusters 150 are secured at positions 158 corresponding to a maximum (or widest) base width setting. In this configuration, the laterally inner edges 146, 148 are rotated away from the respective laterally outer edges 126, 148 of FIG. 3C. In other words, the dart legs are opened to release the darts and create less shape (curve) at the end of the gusset portions 170. By fastening base width adjusters 150 to waist belt 115 such that they are maximally distal one another (again, given the range of possible setting for coupling base width adjusters 150 to waist belt 115), tension may be maintained on outer edges of gusset portions 170 such that gusset portions 170 remain relatively flat. As such, bucket seat portion 120 may be maintained in a relatively flat or less shaped configuration, serving to minimize the depth of the bucket seat 125.

Base width adjusters 150 primarily adjust the width of the seat proximate to waist belt 115. However, moving away from waist belt 115, the seat (edges 142, 144) may flare out. With reference to FIG. 2, thigh width adjusters 160 may be provided to adjust the width of the seat away from waist belt 115. In particular, thigh width adjusters 160 may be adapted to adjust the width of the bucket seat where edges 142, 144 of thigh supports 140 pass under the child's thighs. Thigh width adjusters 160 can be used to pull in thigh support areas 140 so that thigh support areas 140 do not extend past the child's knee and thus prevent thigh support areas 140 from straightening the child's legs or overspreading the child's legs.

In certain embodiments, thigh width adjusters 160 may be coupled to respective thigh support areas 140 and are configured to adjust the width of the carrier at the level of thigh support areas 140. In accordance with one embodiment, each thigh width adjuster 160 may be a piece of material(s) (webbing or other material) that is coupled at a first end 162 to the respective thigh support area 140 proximate to support portions 141 and includes a second end that can be selectively coupled to main body 110 (e.g., to seat center portion 122 or elsewhere). The thigh width adjusters 160 can act as a drawstring system, one on each side, to adjust the width of carrier 100 at thigh level by pulling the thigh support areas 140 laterally inward and thereby further adjusting the width of carrier 100 at the child's thighs.

Figure 4C:
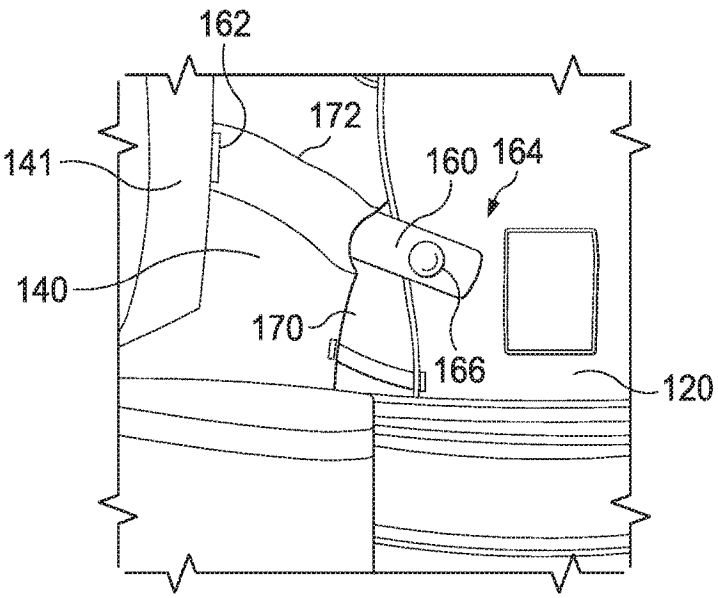
FIG. 4C is a diagrammatic representation of one embodiment of a carrier with thigh width adjusters in a third thigh width adjuster configuration.
Figure 4B:
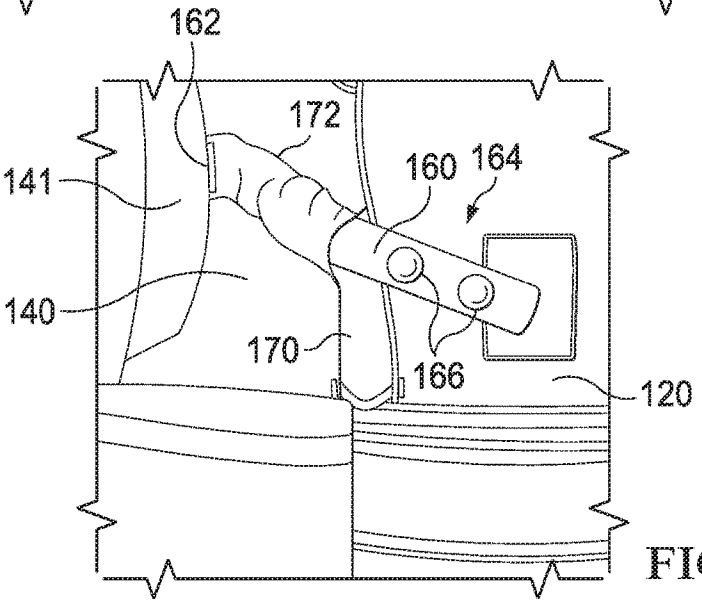
FIG. 4B is a diagrammatic representation of one embodiment of a carrier with thigh width adjusters in a second thigh width adjuster configuration.
Figure 4A:
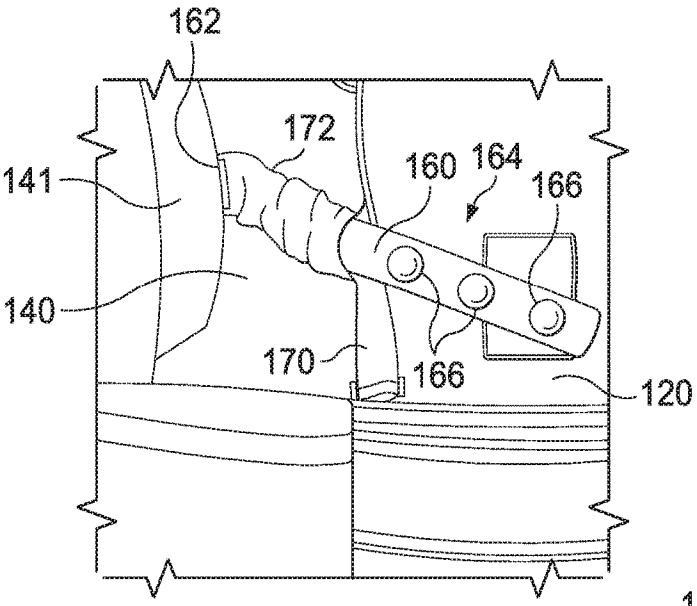
FIG. 4A is a diagrammatic representation of one embodiment of a carrier with thigh width adjusters in a first thigh width adjuster configuration.
Figure 5A:
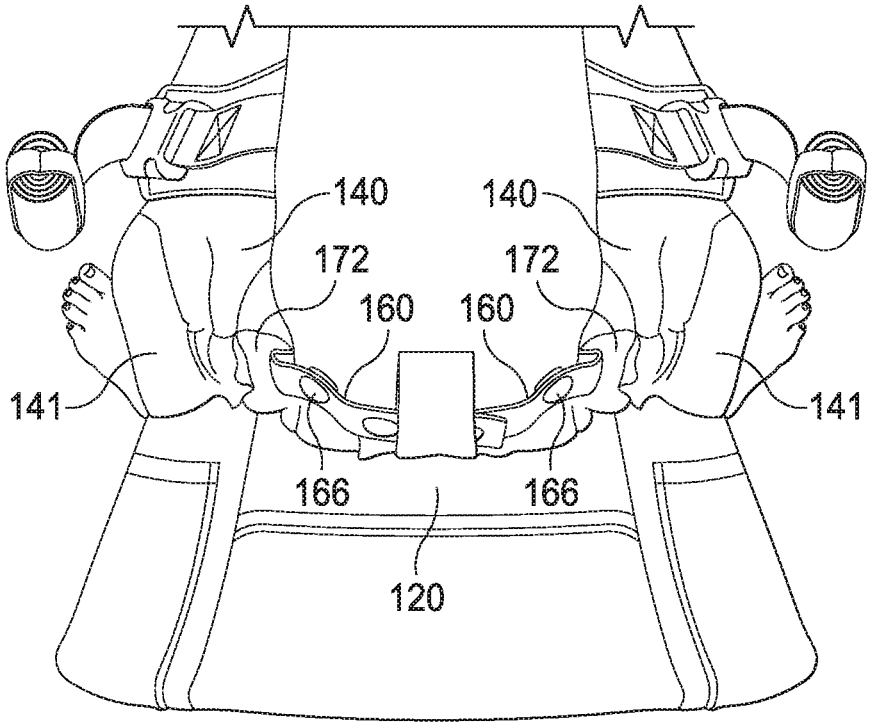
FIG. 5A is a diagrammatic representation of another view one embodiment of a carrier with thigh width adjusters in the first thigh width adjuster configuration.
Figure 5B:
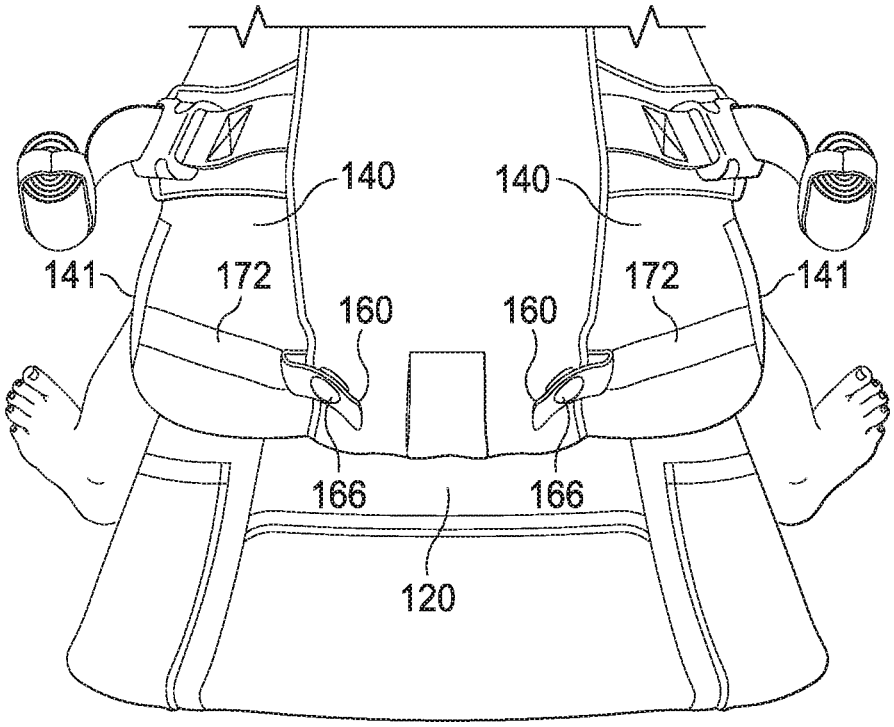
FIG. 5B is a diagrammatic representation of another view of one embodiment of a carrier with thigh width adjusters in the third thigh width adjuster configuration.

Referring briefly to FIGS. 4A, 4B and 4C (collectively FIG. 4) and FIGS. 5A and 5B (collectively FIG. 5), the operation of one embodiment of thigh width adjusters 160 is illustrated. Thigh width adjusters 160 can be selectively coupled to bucket seat portion 120 to pull thigh support areas 140 laterally inward a desired amount. FIG. 4, for example, illustrates the thigh width adjuster 160 secured in three positions corresponding to a narrowest (tightest) setting (FIG. 4A, FIG. 5A), a moderate setting (FIG. 4B) and a widest (loosest) setting (FIG. 4C, FIG. 5B).

In the embodiment illustrated, each thigh width adjuster 160 includes a strip of material that is fastened at first end 162 to the outside of a respective thigh support area 140 proximate to the thigh padding 141 (e.g., near the respective outer edge 142, 144). The thigh width adjuster 160 runs laterally inboard through a fabric tunnel 172 to a distal portion 164 that includes a plurality of spaced thigh width adjuster fasteners 166 (e.g., snaps, buttons, hook and loop, etc.) that can be selectively fastened to a corresponding fastener on bucket seat portion 120 of main body 110.

In FIG. 4A, the thigh width adjuster fastener 166 that is closest to the respective thigh support area 140 is fastened to the corresponding fastener on the bucket seat portion 120. This position corresponds to a narrowest thigh width adjuster setting and, as illustrated in FIG. 5A, thigh support area 140 is gathered inward to decrease the width of carrier 100 at the child's thighs. Conversely, fastening the fastener 166 that is farthest from the respective thigh support area 140 to bucket seat portion 120, as shown in FIG. 4C, may achieve the widest setting of the thigh width adjusters 160. When the thigh width adjusters 160 are in the widest setting position of FIG. 4C, the outer edges of the thigh support areas 140 can spread out as illustrated in FIG. 5B, thus widening carrier 100 at the child's thighs.

As can be understood from the foregoing, the base width adjusters 150 and the thigh width adjusters 160 may work in cooperation to adjust the carrier 100. In accordance with one embodiment, base width adjusters 150 can be used for adjustment of seat depth and provide a gross adjustment of seat width, while thigh width adjusters 160 may serve as granular adjustments for width within the range of gross adjustment provided by the base width adjusters 150. For example, at a particular setting of the base width adjusters 150 of the carrier 100, the width of the carrier 100 at thigh support areas 140 may be narrowest with the thigh width adjusters 160 at their smallest or narrowest (tightest) setting and largest with the thigh width adjusters 160 at their widest (loosest) setting.

Carrier 100 may also adjust in height based on other settings of carrier 100. In particular, adjusting base width adjusters 150 adjusts the wearable back height (length from bottom of bucket seat 125 to top edge 132). This occurs because the length of the physical carrier material from the top edge 116 of the waist belt 115 at center to the top edge 132 of main body 110 at center remains consistent such that the wearable back height changes depending on the setting of the bucket seat size. A deeper bucket consumes more length of material between edges 116 and 132, thus leaving less measurement for the wearable height On the other hand, a shallower bucket consumes less length of material between edges 116 and 132, thus leaving more measurement for the wearable height.

Thus, adjusted to a smallest child mode (e.g., an infant mode) (base width at its smallest/narrowest setting) the bucket seat 125 may be deeper consuming more of the carrier length measurement, thus leaving less measurement for the wearable height (length from bottom of bucket seat 125 to top edge of carrier center panel 123 at center is at its shortest height). Adjusted to a largest child mode (e.g., a toddler mode) (base width at its largest/widest setting) the bucket seat 125 is shallow consuming less of the carrier length measurement, thus leaving more measurement for the wearable height (length from bottom of bucket seat 125 to top edge of carrier center panel 123 at center at its longest height). The carrier thus adjusts to the height of the child based on adjustment to the bucket seat.

Carrier 100 may be adjusted to provide ergonomic support for the child regardless of the size of the child through a supported range. In accordance with one embodiment, carrier 100 can be set for an infant with base width adjusters 150 and thigh width adjusters 160 set at their narrowest settings. In this configuration, the bucket seat will be at its deepest with higher walls at the thigh support areas 140 lifting the child's thighs and knees to a greater angle and into a spread squat position appropriate for that size child. Similarly, carrier 100 can be set for the largest child with the base width adjusters 150 and the thigh width adjusters 160 at their widest settings. In this configuration, the bucket seat may be at its shallowest depth with lower walls at the thigh support areas 140 lifting the child's thighs and knees to a lesser angle and into a spread squat position appropriate for a larger sized child.

Thus, the adjustable bucket seat is configurable in a plurality of configurations having different seat bucket depths and seat bucket widths. The different configurations can be adapted to support a child in a corresponding size range in a spread squat position. For example, in one embodiment, the bucket seat can have a first configuration adapted to ergonomically carry a child of 20-24 inches (generally corresponding to an infant of 0-3 months and over 7 pounds) in a spread squat position appropriate for the infant without requiring an infant insert. Furthermore, the carrier can have a second configuration adapted to ergonomically carry a child of 24-28 inches (generally corresponding to an older baby of 3-9 months) in a spread squat position appropriate for that child's size. In addition, the carrier, in this example, can have a third configuration adapted to ergonomically carry a child of 28 inches or greater (generally corresponding to an older baby or toddler of 9-48 months (up to the carrying capacity of the carrier or the wearer)). The first configuration can correspond to the base width being at the narrowest setting (deepest bucket seat) (an infant mode), the second configuration can correspond to the base width being at a moderate setting and the third configuration can correspond to the base width being at a widest setting (shallowest bucket seat) (a toddler mode). It can be noted that the ranges provided above are provided by way of example and not limitation. Furthermore, the seat may have other configurations.

The user can thus adjust the bucket seat 125 to support the child in an ergonomic spread squat position appropriate for the weight or size of the child with the child's pelvis, bottom and thighs all being supported. The child's weight can be supported so that the child is squatting in the seat rather than sitting with the child's weight primarily on the sacrum. The child can be supported with the knees higher than the bottom, in some cases higher than 90 degrees. The bucket seat 125 can be adjusted to form a sling or pouch that is wider than the child's hips in which the child's bottom is supported. The thigh support areas 140 can be adjusted to pass under and around the child's thighs at a distance from the child's hips such that the portions of thigh support areas 140 that pass under and around the child's thighs are higher than the child's bottom to lift the child's knees. The thigh support areas 140 can have sufficient stiffness to encourage the child's thighs to spread by the thigh support straps or wearer's torso.

Figure 6C:
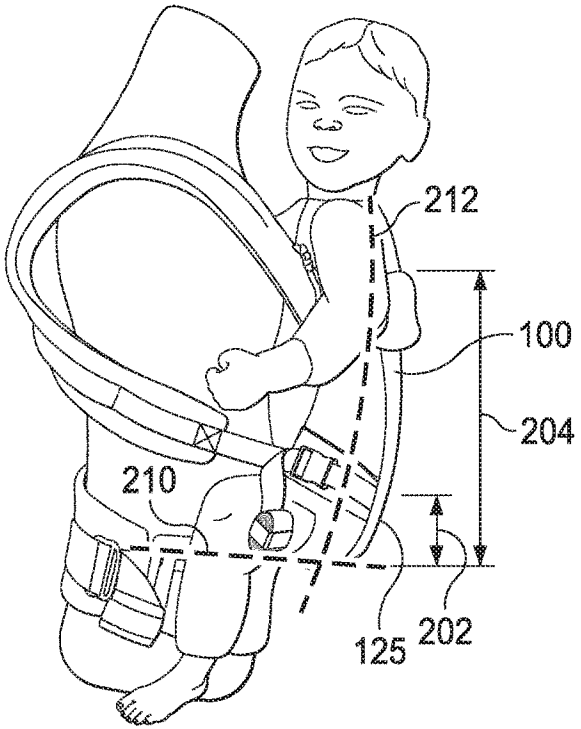
FIG. 6C is a diagrammatic representation of one embodiment of a carrier with bucket seat in a third seat configuration.
Figure 6B:
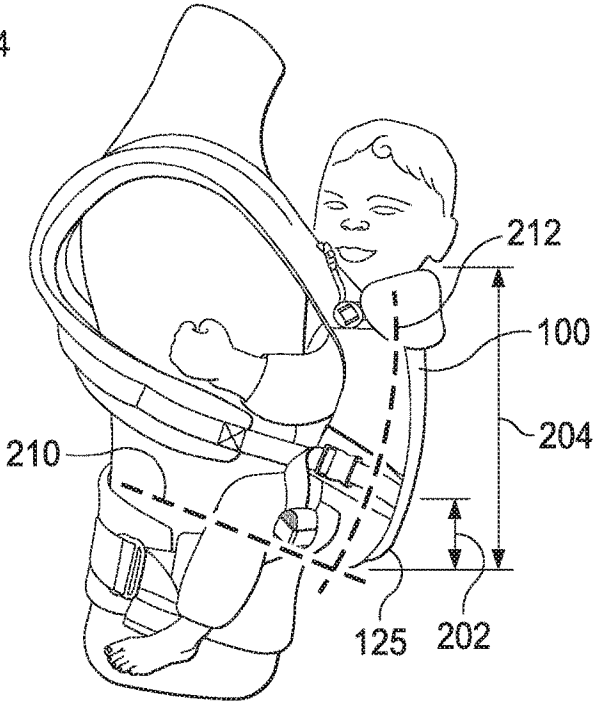
FIG. 6B is a diagrammatic representation of one embodiment of a carrier with bucket seat in a second seat configuration.
Figure 6A:
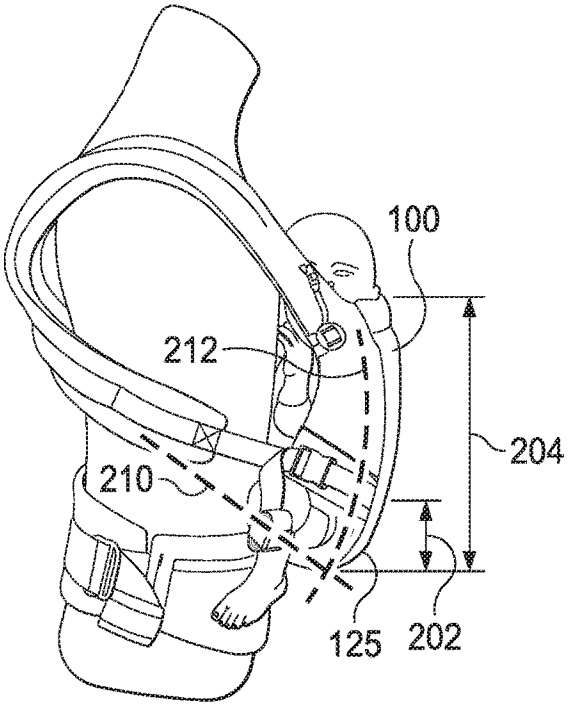
FIG. 6A is a diagrammatic representation of one embodiment of a carrier with bucket seat in a first seat configuration.

FIGS. 6A, 6B and 6C (collectively FIG. 6) are diagrammatic representations of one embodiment of carrier 100 adjusted to accommodate various sized children. FIG. 6A corresponds to the minimum base width setting of FIG. 3A, FIG. 6B corresponds to a moderate base width setting of FIG. 3B and FIG. 6C corresponds to the maximum base width setting of FIG. 3C. Through adjustment of base width adjusters 150 and thigh width adjusters 160, the width of bucket seat 125 and the depth of bucket seat 125 (indicated by depth 202) can be configured. Furthermore, because the length of material of carrier 100 available to support the back depends on the depth of bucket seat 125, adjusting base width adjusters 150 also adjusts the minimum wearable height 204 of carrier 100. As illustrated in FIG. 6, the wearable height 204 of carrier 100 increases with decreasing bucket depth.

With all settings set for a small baby, the seat center portion 122, gusset portions 170 and thigh support areas 140 cooperate to form a deep bucket seat 125 as illustrated in FIG. 6A. The deep bucket seat 125 with higher walls at the thigh (under the knee) tends to lift the child's knees (indicated by line 210) to the appropriate spread squat position and promotes rounding of the back into a c-shape (indicated by line 212). Moreover, a deeper bucket seat 125 shortens the wearable height 204. Thus, the configuration of FIG. 6A may be suitable for infants. As the child grows, the child's spine should naturally straighten and the child will require less knee support. Base width adjusters 150 and thigh width adjusters can be adjusted to widen bucket seat 125 and provide additional back support length to support the child's lengthening spine. As shown in FIG. 6B and FIG. 6C, for example, carrier 100 the bucket seat 125 may be adjusted to provide less knee lift, but enough to maintain an appropriate spread squat position (e.g., for an older baby in FIG. 6B and for a toddler in FIG. 6C) and allow the child to rest with a straighter back.

Returning to FIG. 2, carrier 100 may also include an adjustable neck support 180. Adjustable neck support 180 may be extended to increase the center height of carrier 100, giving additional back or neck support for a child (depending on the size of the child). The neck support 180 may also be folded back away from the wearer to reduce the height of the carrier (e.g., for non-infant children). The neck support 180 may also be folded down toward the wearer such that it may reside inside the child carrying area to give an infant or other child additional head or neck support. The size, shape and position of neck support 180 can be selected so that neck support 180 will fit behind and support the average infant's neck when neck support 180 is folded into the carrier.

Complementary extended position securing mechanisms and complementary non-extended position securing mechanisms such as, but not limited to, buttons, snaps, d-rings and clips or hooks, patches of hook and loop material or other securing mechanism, can be provided so that adjustable neck support 180 can be secured in an extended position or folded back and secured in a non-extended position.

Figure 7A:
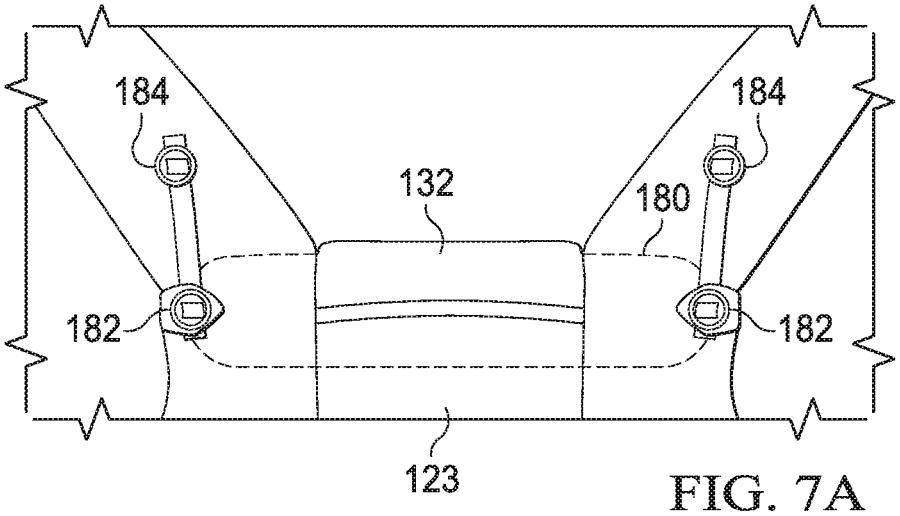
FIG. 7A is a diagrammatic representation of one embodiment of a carrier with a neck support in a first neck support configuration.
Figure 7B:
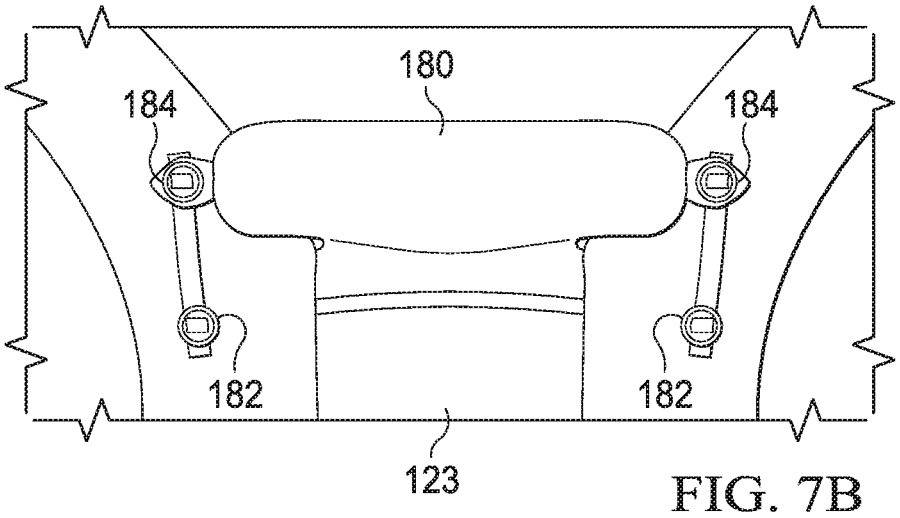
FIG. 7B is a diagrammatic representation of one embodiment of a carrier with a neck support in a second neck support configuration.
Figure 7C:
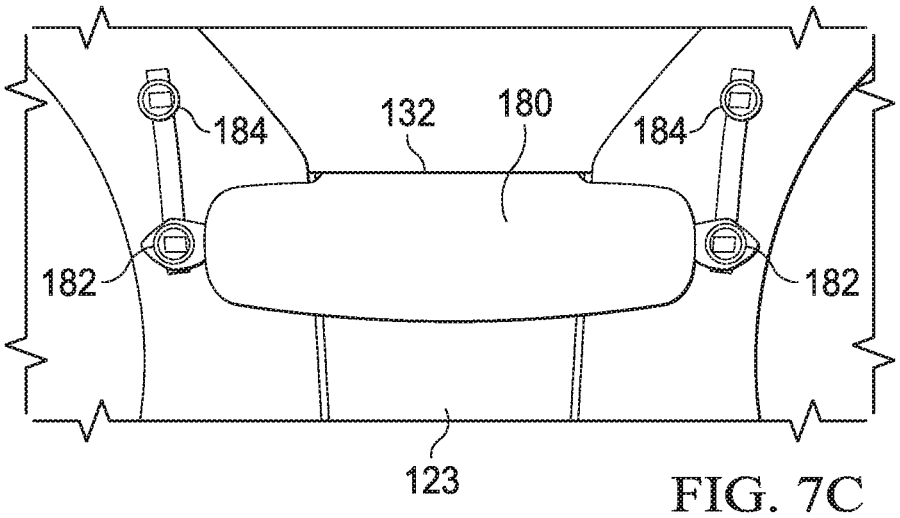
FIG. 7C is a diagrammatic representation of one embodiment of a carrier with a neck support in a third neck support configuration.

FIGS. 7A, 7B and 7C illustrate one embodiment of adjustable neck support 180 in an inside folded down configuration, an extended configuration and an outside folded down configuration respectively. In the inside folded down position of FIG. 7A, adjustable neck support 180 can be adapted to partially fill the inside of the carrying area of carrier 100 to give infants with insufficient head control more head and neck support (see also FIG. 6A). Adjustable neck support 180 can also be configured in the outside folded down configuration of FIG. 7B to provide additional volume in the carrier as the child grows (see also FIGS. 6B and 6C). Neck support 180 can be configured in the extended mode (flipped up) as illustrated in FIG. 7C to increase the center back length, giving additional back support for toddlers or head and neck support for non-infant babies. Neck support 180 may be positioned according to the size of the child, or other criteria.

According to one embodiment, adjustable neck support 180 may be joined to main body 110 proximate to top edge 132. The coupling may form a generally horizontal hinge that allows adjustable neck support 180 to flip over edge 132 from the inside folded down configuration to the outside folded down configuration. In the embodiment illustrated, adjustable neck support 180 may be secured in the inside folded down configuration and outside folded down configuration using first set of neck support fasteners 182 and may be secured in the extended configuration using a second set of neck support fasteners 184 located above the first set of neck support fasteners 182. Preferably, but not necessarily, the neck support fasteners are located on the outside of main body 110.

With reference again to FIG. 2, shoulder straps 190 can be configured to form a loop and attach on either side of the lateral centerline of carrier 100. In other embodiments, shoulder straps may be worn in an "x" configuration. Each shoulder strap 190 may connect to upper torso support portion 130 at one or more locations to pull upper torso support portion 130 toward the wearer. A shoulder strap may also couple to main body 110 of carrier 100 above thigh support areas 140 or other portion of carrier 100 on the same side, or an opposite side, of the centerline where the shoulder strap 190 is coupled to the upper torso support portion 130. Shoulder straps 190 may be adjustable and, in some cases, can be re-configured to support multiple carrier positions, such as a front carry, side carry position (hip carry) or back carry position.

Waist belt 115 may have a lumbar support portion 119 and be configured to rest on the wearer's hips. Preferably, the harness is configured so that the child's weight is evenly distributed to the wearer's hips and shoulders and even more preferably such that the child's weight is distributed evenly to the wearer's hips and shoulders and in some cases primarily to the wearer's hips rather than shoulders. In some cases, 70 percent or more of the child's weight can be distributed to the wearer's hips through waist belt 115, thereby promoting wearer comfort and diminishing wearer fatigue.

In accordance with one aspect of the present disclosure, carrier 100 can be a soft structured carrier that incorporates padding, stitching and fabrics to provide structure. Main body 110, including upper torso support portion 130, bucket seat portion 120, thigh supports 140 and thigh width adjusters 150 can be flexible and can be formed primarily of natural or synthetic fibers without a rigid frame. As would be understood by a person of ordinary skill in the art, however, some components, such as buckles, fasteners, etc. of a soft structured carrier may be formed of hard plastics, metals and the like.

Carrier 100 may include one or more panels formed from a single piece of material or multiple pieces of material, multiple layers of materials, or multiple materials. For example, in some embodiments, upper torso support portion 130 may be formed with an inner layer selected for comfort against a child's skin and an outer layer selected for breathability, fashion, stain resistance, etc. Upper torso support portion 130 may have straight edges, tapered edges for an area of increased width or decreased width, or otherwise configured for comfort or security of a child or a user. Similarly, bucket seat portion 120 may include one or more panels formed from a single piece of material, or may be formed from multiple pieces of material, multiple layers of materials, or multiple materials. The junction between upper torso support portion 130 and bucket seat portion 120 may be a substantially seamless transition. In one embodiment, the center of upper torso support portion 130 and center of bucket seat portion 120 may be formed from a unitary center panel 123 (of one or more layers) attached to side panels that form the laterally outer portions of upper torso support portion 130 and thigh support areas 140. Inner layers may be selected for comfort against a child's skin and outer layers selected for breathability, fashion, stain resistance, etc. In some embodiments, the center portion may be selected for comfort and lateral portions selected for breathability, security, etc.

Figure 9:
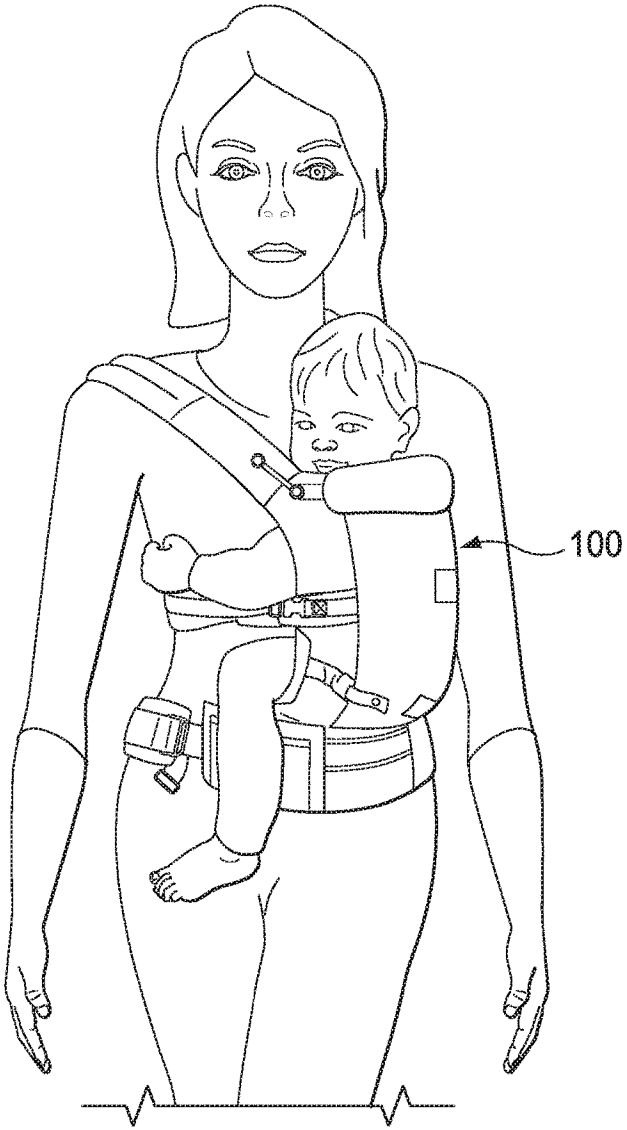
FIG. 9 is a diagrammatic representation of one embodiment of a wearer wearing a carrier in a side carry configuration.
Figure 8:
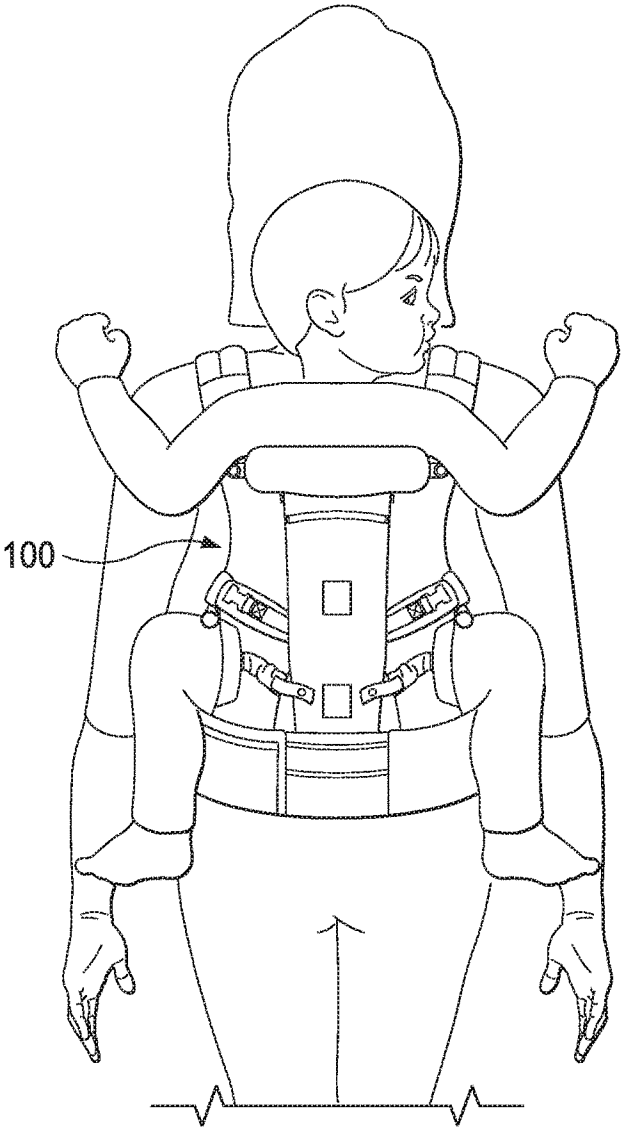
FIG. 8 is a diagrammatic representation of one embodiment of a wearer wearing a carrier in a back carry position.

It can be noted that carrier 100 may support a number of carrying positions. FIG. 1, for example, is a diagrammatic representation of one embodiment of an adult wearer carrying a child in an inward facing front carry position. FIG. 8 is a diagrammatic representation of one embodiment of an adult wearer carrying a child in carrier 100 in an inward facing back wearing configuration. FIG. 9 is a diagrammatic representation of one embodiment of an adult wearer carrying a child in carrier 100 in a side (hip) wearing configuration.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present). As used herein, a term preceded by "a" or "an" (and "the" when antecedent basis is "a" or "an") includes both singular and plural of such term, unless clearly indicated otherwise (i.e., that the reference "a" or "an" clearly indicates only the singular or only the plural). Also, as used in the description herein and throughout the meaning of "in" includes "in" and "on" unless the context clearly dictates otherwise.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms. Language designating such nonlimiting examples and illustrations include, but is not limited to: "for example," "for instance," "e.g.," "in one embodiment."

Reference throughout this specification to "one embodiment", "an embodiment", or "a specific embodiment" or similar terminology means that a particular feature, structure, or characteristic described in connection with the embodiment is included in at least one embodiment and may not necessarily be present in all embodiments. Thus, respective appearances of the phrases "in one embodiment", "in an embodiment", or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application. Additionally, any signal arrows in the drawings/Figures should be considered only as exemplary, and not limiting, unless otherwise specifically noted.

The representative embodiments, which have been described in detail herein, have been presented by way of example and not by way of limitation. It will be understood by those skilled in the art that various changes may be made in the form and details of the described embodiments resulting in equivalent embodiments that remain within the scope of the appended claims.

What is claimed is:

1. A child carrier comprising:

a waist belt adapted for securing about a wearer's hips;

a main body coupled to the waist belt, the main body adapted to form a child carrying area in cooperation with a wearer's torso, the main body comprising:

a torso support portion configured for supporting at least of a torso of a child;

an adjustable bucket seat configurable in a plurality of bucket seat configurations, each of the plurality of bucket seat configurations having a different a) bucket seat depth and b) bucket seat width and adapted to support the child in a corresponding size range in a spread squat position, the adjustable bucket seat comprising a set of base width adjusters adapted to adjust the bucket seat width at the waist belt; and a set of thigh width adjusters adapted to adjust a width of the adjustable bucket seat away from the waist belt, wherein the set of base width adjusters are adapted to provide gross bucket seat width control and the set of thigh width adjusters are adapted to provide more granular bucket seat width control than the set of base width adjusters.

2. The child carrier of claim 1, wherein the plurality of bucket seat configurations comprises:

a first configuration for a first size range of child; and a second configuration for a second size range of child, the first configuration having a first bucket seat width and first bucket seat depth and the second configuration having a second bucket seat width and a second bucket seat depth, wherein the first bucket seat width is less than the second bucket seat width and the first bucket seat depth is greater than the second bucket seat depth.

3. The child carrier of claim 1, wherein the child carrier has a minimum wearable height that is dependent on the bucket seat depth.

4. The child carrier of claim 1, wherein:

the adjustable bucket seat comprises:

a seat center portion coupled to the waist belt and the torso support portion;

a first thigh support disposed on a first side of the seat center portion; and a second thigh support disposed on a second side of the seat center portion;

the set of base width adjusters comprises:

a first base width adjuster adapted to selectively couple the first thigh support to the waist belt at a first plurality of locations; and a second base width adjuster adapted to selectively couple the second thigh support to the waist belt at a second plurality of locations; and the set of thigh width adjusters comprises:

a first thigh width adjustment strap having a first end coupled to the first thigh support and a distal portion adapted to couple to the main body laterally inward of the first thigh support, the first thigh width adjustment strap adjustable to pull the first thigh support laterally inward; and a second thigh width adjustment strap having a first end coupled to the second thigh support and a distal portion adapted to couple to the main body laterally inward of the second thigh support, the second thigh width adjustment strap adjustable to pull the second thigh support laterally inward.

5. The child carrier of claim 4, further comprising:

a first thigh width adjustment strap fastener located laterally inward of the first thigh support; and a second thigh width adjustment strap fastener located laterally inward of the second thigh support, wherein the first thigh width adjustment strap distal portion includes a first plurality of spaced fasters adapted to selectively fasten to the first thigh width adjustment strap fastener and the second thigh width adjustment strap distal portion comprises a second plurality of spaced fasteners adapted to selectively couple to the second thigh width adjustment strap fastener.

6. The child carrier of claim 4, wherein in the set of base width adjusters are configured for selective coupling to the waist belt in multiple locations to adjust the bucket seat depth.

7. The child carrier of claim 4, further comprising darts, wherein the seat center portion comprises a first laterally outer edge and a second laterally outer edge, the first thigh support comprises a first laterally inner edge, the second thigh support comprises a second laterally inner edge, and the darts comprise a first dart disposed between first laterally outer edge and the first laterally inner edge and a second dart disposed between the second laterally outer edge and the second laterally inner edge.

8. The child carrier of claim 7, wherein the first thigh support is adjustable to rotate the first laterally inner edge relative to the first laterally outer edge to open or close the first dart and the second thigh support is adjustable to rotate the second laterally inner edge relative to the second laterally outer edge to open or close the second dart.

9. The child carrier of claim 1, wherein adjustment of the bucket seat depth adjusts a minimum wearable height of the child carrier.

10. The child carrier of claim 1, further comprising a neck support configurable in an inside folded down position in which the neck support is positioned in the child carrying area to support a child's neck.

11. The child carrier of claim 10, wherein the neck support is further configurable in an extended folded up position and an outside folded down position.

12. The child carrier of claim 1, wherein the plurality of bucket seat configurations comprises a configuration adapted to support an infant without using an infant insert.

13. The child carrier of claim 1, wherein the plurality of bucket seat configurations comprises a configuration adapted to support a toddler in a spread squat position.

14. A child carrier comprising:

a waist belt adapted for securing about a wearer's hips;

a main body coupled to the waist belt, the main body adapted to form a child carrying area in cooperation with a wearer's torso, the main body comprising:

a torso support portion configured for supporting at least of a torso of a child;

a seat center portion coupled to the torso support portion and the waist belt;

a first thigh support disposed to a first side of the seat center portion, the first thigh support adapted to pass under and support a first thigh of the child, the first thigh support having a first thigh support inner end adapted to selectively couple to the waist belt at a first plurality of locations; and a second thigh support disposed to a second side of the seat center portion, the second thigh support adapted to pass under and support a second thigh of the child, the second thigh support having a second thigh support inner end adapted to selectively couple to the waist belt in a second plurality of locations, wherein the first thigh support, second thigh support and seat center portion are adapted to cooperate to form a bucket seat and wherein the first thigh support and the second thigh support are adapted to selectively couple to the waist belt to adjust a width of the bucket seat at the waist belt and a depth of the bucket seat;

a first thigh width adjustment strap having a first end coupled to the first thigh support and a distal portion adapted to couple to the main body laterally inward of the first thigh support; and a second thigh width adjustment strap having first end coupled to the second thigh support and a distal portion adapted to couple to the main body laterally inward of the second thigh support strap, wherein the first thigh width adjustment strap is adjustable to pull the first thigh support laterally inward and the second thigh width adjustment strap adjustable to pull the second thigh support laterally inward to adjust a width of the bucket seat away from the waist belt.

15. The child carrier of claim 14, wherein the bucket seat is configurable in a plurality of bucket seat configurations, each having a different bucket seat depth and bucket seat width.

16. The child carrier of claim 15, wherein the plurality of bucket seat configurations comprises a configuration adapted to support an infant without using an infant insert.

17. The child carrier of claim 15, wherein the plurality of bucket seat configurations comprises a configuration adapted to support a toddler.

18. The child carrier of claim 14, wherein the child carrier has a minimum wearable height that is dependent on the bucket seat depth.

19. The child carrier of claim 14, further comprising a neck support configurable in an inside folded down position in which the neck support is positioned in the child carrying area to support a child's neck.

20. The child carrier of claim 19, wherein the neck support is further configurable in an extended folded up position and an outside folded down position.

* * * * *